US007866400B2

(12) United States Patent
Steele et al.

(10) Patent No.: US 7,866,400 B2
(45) Date of Patent: Jan. 11, 2011

(54) PHASE-CONTROLLED WELL FLOW CONTROL AND ASSOCIATED METHODS

(75) Inventors: David J. Steele, Arlington, TX (US); Travis W. Cavender, Angleton, TX (US); Roger L. Schultz, Ninnekah, OK (US); Robert L. Pipkin, Duncan, OK (US); Gary P. Funkhouser, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 300 days.

(21) Appl. No.: 12/039,206

(22) Filed: Feb. 28, 2008

(65) Prior Publication Data

US 2009/0218089 A1 Sep. 3, 2009

(51) Int. Cl.
*E21B 43/25* (2006.01)
*E21B 34/06* (2006.01)

(52) U.S. Cl. ..... 166/373; 166/386; 166/319

(58) Field of Classification Search ..... 166/250.15, 166/373, 386, 319
See application file for complete search history.

(56) References Cited

U.S. PATENT DOCUMENTS

| | | | | |
|---|---|---|---|---|
| 2,942,668 | A * | 6/1960 | Maly et al. | 166/185 |
| 3,651,655 | A | 3/1972 | Dyre | |
| 4,109,725 | A | 8/1978 | Williamson et al. | |
| 4,768,591 | A | 9/1988 | Long et al. | |
| 5,209,303 | A * | 5/1993 | Barrington | 166/374 |
| 6,257,334 | B1 | 7/2001 | Cyr et al. | |
| 6,490,916 | B1 | 12/2002 | Goodwin et al. | |
| 7,032,675 | B2 | 4/2006 | Steele et al. | |
| 7,147,057 | B2 | 12/2006 | Steele et al. | |
| 2005/0072578 | A1 | 4/2005 | Steele et al. | |
| 2007/0284118 | A1 | 12/2007 | Benton | |
| 2008/0035350 | A1 | 2/2008 | Henriksen et al. | |
| 2009/0218089 | A1 * | 9/2009 | Steele et al. | 166/53 |
| 2009/0250224 | A1 * | 10/2009 | Wright et al. | 166/373 |

FOREIGN PATENT DOCUMENTS

| | | |
|---|---|---|
| GB | 2252797 A | 8/1992 |
| WO | WO2008091345 | 7/2008 |

OTHER PUBLICATIONS

International Search Report and Written Opinion issued Apr. 10, 2009, for International Patent Application Serial No. PCT/US09/34176, 7 pages.

International Preliminary Report on Patentability issued Sep. 10, 2010, for International Patent Application Serial No. PCT/US09/34176, 6 pages.

* cited by examiner

*Primary Examiner*—Jennifer H Gay
(74) *Attorney, Agent, or Firm*—Marlin R. Smith

(57) ABSTRACT

Phase-controlled well flow control. A well system includes a flow control device which regulates flow of a fluid in the well system, the flow control device being responsive to both pressure and temperature in the well system to regulate flow of the fluid. A flow control device includes a flow regulator for regulating flow of a fluid through the flow control device, and an actuator which is operative to actuate the flow regulator in response to a predetermined relationship between a phase of the fluid and both pressure and temperature exposed to the actuator. A method of controlling a phase change of a fluid in a well system includes the steps of: flowing the fluid through a flow control device in the well system; and adjusting the flow control device in response to both pressure and temperature in the well system.

20 Claims, 19 Drawing Sheets

PHASE-CONTROLLED WELL FLOW CONTROL AND ASSOCIATED METHODS

BACKGROUND

The present disclosure relates generally to equipment utilized and operations performed in conjunction with a subterranean well and, in an embodiment described herein, more particularly provides phase-controlled well flow control.

Many reservoirs containing valuable quantities of hydrocarbons have been discovered in subterranean formations from which recovery of the hydrocarbons has been very difficult due to a relatively high viscosity of the hydrocarbons and/or the presence of viscous tar sands in the formations. In particular, when a production well is drilled into a subterranean formation to recover oil residing therein, often little or no oil flows into the production well even if a natural or artificially induced pressure differential exits between the formation and the well. To overcome this problem, various thermal recovery techniques have been used to decrease the viscosity of the oil and/or the tar sands, thereby making the recovery of the oil easier.

One such thermal recovery technique utilizes steam to thermally stimulate viscous hydrocarbon production by injecting steam into a wellbore to heat an adjacent subterranean formation. However, the steam typically is not evenly distributed throughout the wellbore, resulting in a temperature gradient along the wellbore. As such, areas that are hotter and colder than other areas of the wellbore (i.e., hot spots and cold spots) undesirably form in the wellbore.

The cold spots lead to the formation of pockets of hydrocarbons that remain immobile. Further, the hot spots allow the steam to break through the formation and pass directly to a production wellbore, creating a path of least resistance for the flow of steam to the production wellbore. Consequently, the steam bypasses a large portion of the hydrocarbons residing in the formation, thus failing to heat and mobilize the hydrocarbons, and flow of the steam into the production wellbore can lead to damage to the surrounding formation, production of formation fines, etc.

Therefore, it may be seen that improvements are needed in the art of flow control in wells. These improvements may be usable in applications other than the thermal recovery techniques discussed above.

SUMMARY

In the present specification, phase-controlled well flow controls and associated methods are provided which solve at least one problem in the art. One example is described below in which a flow control device is actuated in a manner which is controlled based on a relationship between a phase of fluid flowing through the device, and pressure and temperature of the fluid. Another example is described below in which the flow control device includes an actuator with a substance in a chamber and configured so that a volume of the chamber varies to control actuation of the device, with the substance responding to the pressure and temperature of the fluid flowing through the device or otherwise exposed to the actuator.

In one aspect, a well system is provided by the present disclosure which includes a flow control device which regulates flow of a fluid in the well system. The flow control device is responsive to both pressure and temperature in the well system to regulate flow of the fluid.

In another aspect, a flow control device for use in a subterranean well system is provided. The flow control device includes a flow regulator for regulating flow of a fluid through the flow control device in the well system. An actuator of the device is operative to actuate the flow regulator in response to a predetermined relationship between a phase of the fluid and both pressure and temperature exposed to the actuator in the well system.

In yet another aspect, a method of controlling a phase change of a fluid in a well system is provided which includes the steps of: flowing the fluid through a flow control device in the well system; and adjusting the flow control device in response to both pressure and temperature in the well system.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1A:
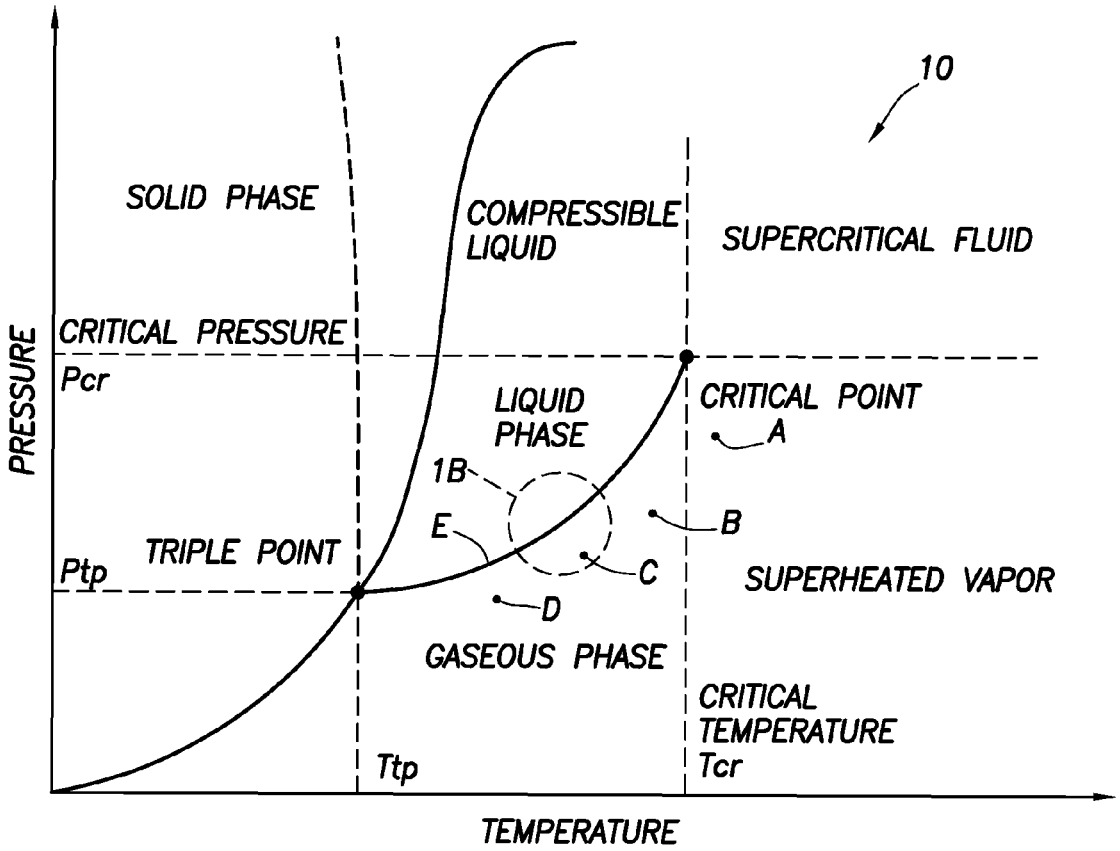
FIGS. 1A & B are a phase diagram and an enlarged detail thereof for a fluid such as water, wherein FIG. 1B demonstrates a method embodying principles of the present disclosure for maintaining a liquid phase of the fluid at a predetermined location in a well system.

Representatively illustrated in FIG. 1A is the well-known phase diagram 10 for water. Water is used herein as an example of a common fluid which is injected into and produced from subterranean formations. In particular, thermally-assisted hydrocarbon recovery methods frequently use injection of water in the form of steam to heat a surrounding formation, and then the water is produced from the formation in liquid form.

Thus, the properties and problems associated with steam injection and subsequent liquid water production in formations are fairly well known in the art. However, it should be clearly understood that the principles of the present disclosure are not limited in any way to the use of water as the injected and/or produced fluid.

Examples of other suitable fluids include hydrocarbons such as naphtha, kerosene, and gasoline, and liquefied petroleum gas products, such as ethane, propane, and butane. Such materials may be employed in miscible slug tertiary recovery processes or in enriched gas miscible methods known in the art.

Additional suitable fluids include surfactants such as soaps, soap-like substances, solvents, colloids, or electrolytes. Such fluids may be used for or in conjunction with micellar solution flooding.

Further suitable fluids include polymers such as polysaccharides, polyacrylamides, and so forth. Such fluids may be used to improve sweep efficiency by reducing mobility ratio.

Therefore, it will be appreciated that any fluid or combination of fluids may be used in addition, or as an alternative, to use of water. Accordingly, the term "fluid" as used herein should be understood to include a single fluid or a combination of fluids, in liquid and/or gaseous phase.

As discussed above, the water is typically injected into the formation after the water has been heated sufficiently so that it is in its gaseous phase. The water could be in the form of superheated vapor (as shown at point A in FIG. 1A) above its critical temperature $T_{cr}$, or in the form of a lower temperature gas (as shown at points B, C & D in FIG. 1A) below the critical temperature, but preferably above the triple point temperature $T_{tp}$.

In the examples described below, it is desired that the water produced from the formation be in its liquid phase, i.e., that the water change phase within the formation prior to being produced from the formation. In this manner, damage to the formation, production of fines from the formation, erosion of production equipment, etc., can be substantially reduced or even eliminated.

However, it is also desired that this phase change take place just prior to production of the water from the formation, so that heat energy transfer from the steam is more consistently applied to the formation, and while the steam is more mobile in the formation, prior to changing to the liquid phase. Thus, in the phase diagram of FIG. 1A, the water produced from the formation would desirably be at a temperature and pressure somewhere along the phase change curve E, or to ensure that production of steam is prevented, just above the phase change curve.

Figure 1B:
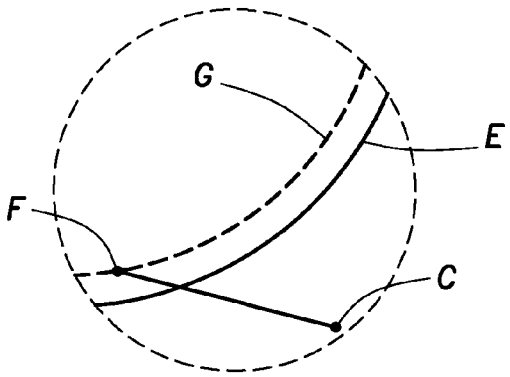

Referring additionally now to FIG. 1B, an enlarged scale detail of a portion of FIG. 1A is representatively illustrated. This detail depicts a fundamental feature of a method embodying principles of the present disclosure.

Specifically, the detail depicts that flow of the fluid (in this example, water) is controlled so that it is injected into the formation at a pressure and temperature corresponding to point C in the gaseous phase, and is produced from the formation at a pressure and temperature corresponding to point F in the liquid phase. Point F is on a curve G which is just above, and generally parallel to, the phase change curve E. Similarly, the fluid could be injected at any of the other points A, B, D in FIG. 1A, and produced at any other point along the curve G.

Preferably, the fluid is produced at a point on the phase diagram which is on the curve G, or at least above curve G. Thus, the curve C represents an ideal production curve representing a desired phase relationship or phase state at the time of production. Stated differently, curve G represents a maximum temperature and minimum pressure phase relationship relative to the liquid/gas phase change curve E.

Note that such phase-based flow control of the fluid cannot be based solely on temperature, since at a same temperature the fluid could be a gas or a liquid, and the flow control cannot be based solely on pressure, since at a same pressure the fluid could also be a gas or a liquid. Instead, this disclosure describes various ways in which the flow control is based on the phase of the fluid.

In the examples described below, various flow control devices are used in well systems to obtain a desired injection of steam and production of water, but it should be understood that this disclosure is not limited to these examples. Various other benefits can be derived from the principles described below. For example, the flow control devices can be used to provide a desired quantitative distribution of steam along an injection wellbore, a desired quantitative distribution of water along a production wellbore, a desired temperature distribution in a formation, a desired steam front profile in the formation, etc.

Referring additionally now to FIGS. 2A-E, an example of a flow control device 12 which embodies principles of the present disclosure is representatively illustrated. In this example, the flow control device 12 includes an actuator 14 and flow regulator 16 which are attached to an exterior of a generally tubular housing 18 having a longitudinally extending flow passage 20.

By attaching the actuator 14 and flow regulator 16 externally to the housing 18, the flow passage 20 is unobstructed. However, in other examples, the actuator 14 and/or flow regulator 16 could be internal to the housing 18, otherwise incorporated into the housing, separate from the housing, etc.

The actuator 14 includes a variable volume chamber 22 in the form of a hermetically sealed bellows. In other examples, the chamber 22 could be in the form of a piston and cylinder, expandable membrane, diaphragm, etc.

A substance 24 is introduced into the chamber 22 by means of a fill valve 26. The substance 24 preferably fills the entire interior of the chamber 22 but, if desired, the volume of the substance could be less than the volume of the chamber.

The substance 24 generally increases in volume in response to increased temperature and decreased pressure, and generally decreases in volume in response to decreased temperature and increased pressure. The substance may be a single substance or a combination of substances. The substance may be liquid, gas, solid or any combination thereof.

An example of a suitable liquid substance is antifreeze, which may be added to another liquid such as water. Examples of antifreeze include methyl alcohol, ethyl alcohol, and ethylene glycol, which may contain a phosphate, nitrate, or other anticorrosive agent. When water is mixed with antifreeze, both its freezing and boiling points are changed. For example, the mixture has a higher boiling point than just water alone.

The substance could be a salt or combination of salts in water to increase the boiling point of the water. The substance could be a gas, hydrocarbon fluid, alcohol, or any combination thereof.

An example of a suitable solid substance for placement within the chamber 22 is a wax material that expands and contracts in response to temperature changes. This wax material may remain in a semi-solid state and may be very sensitive to temperature changes, but not to pressure changes.

Preferably, the substance 24 undergoes a large volume change at the temperature and pressure threshold described by curve G. The largest volume change occurs with a liquid-vapor phase change. The simplest embodiment of substance 24 would be a pure compound that has the phase behavior described by curve G. When the pure compound is subjected to conditions on curve G, the entire volume can undergo a phase change at constant temperature and pressure. However, it may be difficult to find a suitable pure compound that has the desired phase behavior at the conditions of interest.

Mixtures of compounds can be used to obtain the desired boiling point, but with many mixtures the composition of the vapor and liquid are different. In this case as the mixture vaporizes, the composition of the liquid phase is enriched in the higher-boiling point component. This liquid composition change will proceed until the vapor pressure of the remaining liquid equals the applied pressure. To continue vaporizing the remaining liquid, either the temperature must be increased or the pressure must be decreased. With this type of mixture, a large temperature or pressure change may be required to get the full volume change required to actuate the valve.

One way to avoid the limitations of using pure compounds or typical mixtures is to use an azeotrope. Preferably, the substance 24 includes an azeotrope. A broad selection of azeotropes is available that have liquid-gas phase behavior to cover a wide range of conditions that may otherwise not be accessible with single-component liquids.

An azeotrope, or constant-boiling mixture, has the same composition in both the liquid and vapor phases. This means that the entire liquid volume can be vaporized with no temperature or pressure change from the start of boiling to complete vaporization. Mixtures in equilibrium with their vapor that are not azeotropes generally require an increase in temperature or decrease in pressure to accomplish complete vaporization. Azeotropes may be formed from miscible or immiscible liquids.

The boiling point of an azeotrope can be either a minimum or maximum boiling point on the boiling-point-composition diagram, although minimum boiling point azeotropes are much more common. Either type may be suitable for use as the substance 24.

Both binary and ternary azeotropes are known. Ternary azeotropes are generally of the minimum-boiling type. Compositions and boiling points at atmospheric pressure of a few selected binary azeotropes are listed in Table 1 below.

TABLE 1

Composition and properties of selected binary azeotropes.

| Components | | Azeotrope | |
|---|---|---|---|
| Compounds | BP, ° C. | BP, ° C. | Composition, % |
| Nonane | 150.8 | 95.0 | 60.2 |
| Water | 100.0 | | 39.8 |
| 1-Butanol | 117.7 | 93.0 | 55.5 |
| Water | 100.0 | | 44.5 |
| Formic acid | 100.7 | 107.1 | 77.5 |

TABLE 1-continued

Composition and properties of selected binary azeotropes.

| Components | | Azeotrope | |
|---|---|---|---|
| Compounds | BP, ° C. | BP, ° C. | Composition, % |
| Water | 100.0 | | 22.5 |
| Heptane | 98.4 | 79.2 | 87.1 |
| Water | 100.0 | | 12.9 |
| Isopropyl alcohol | 82.3 | 80.4 | 87.8 |
| Water | 100.0 | | 12.2 |
| m-Xylene | 139.1 | 94.5 | 60.0 |
| Water | 100.0 | | 40.0 |
| Cyclohexane | 81.4 | 68.6 | 67.0 |
| Isopropanol | 82.3 | | 33.0 |

The above table is derived from the Handbook of Chemistry and Physics, 56$^{th}$ ed.; R. C. Weast, Ed.; CRC Press: Cleveland; pp. D1-D36.

The composition of an azeotrope is pressure-dependent. As the pressure is increased, the azeotrope composition shifts to an increasing fraction of the component with the higher latent heat of vaporization. The composition of substance 24 should match the composition of the azeotrope at the expected conditions for optimum performance. Some azeotropes do not persist to high pressures. Any prospective azeotrope composition should be tested under the expected conditions to ensure the desired phase behavior is observed.

The chamber 22 changes volume along with the substance 24. The chamber 22 is separated from a piston 28 by a fluid-filled chamber 30. The fluid 32 in the chamber 30 is preferably a temperature-stable and relatively incompressible hydraulic fluid.

As the chamber 22 expands, it forces the fluid 32 to flow through a flow restrictor 34 between the chamber 30 and the piston 28. The restrictor 34 is used to prevent undesirably rapid fluctuations in the position of the piston 28.

Figure 2A:
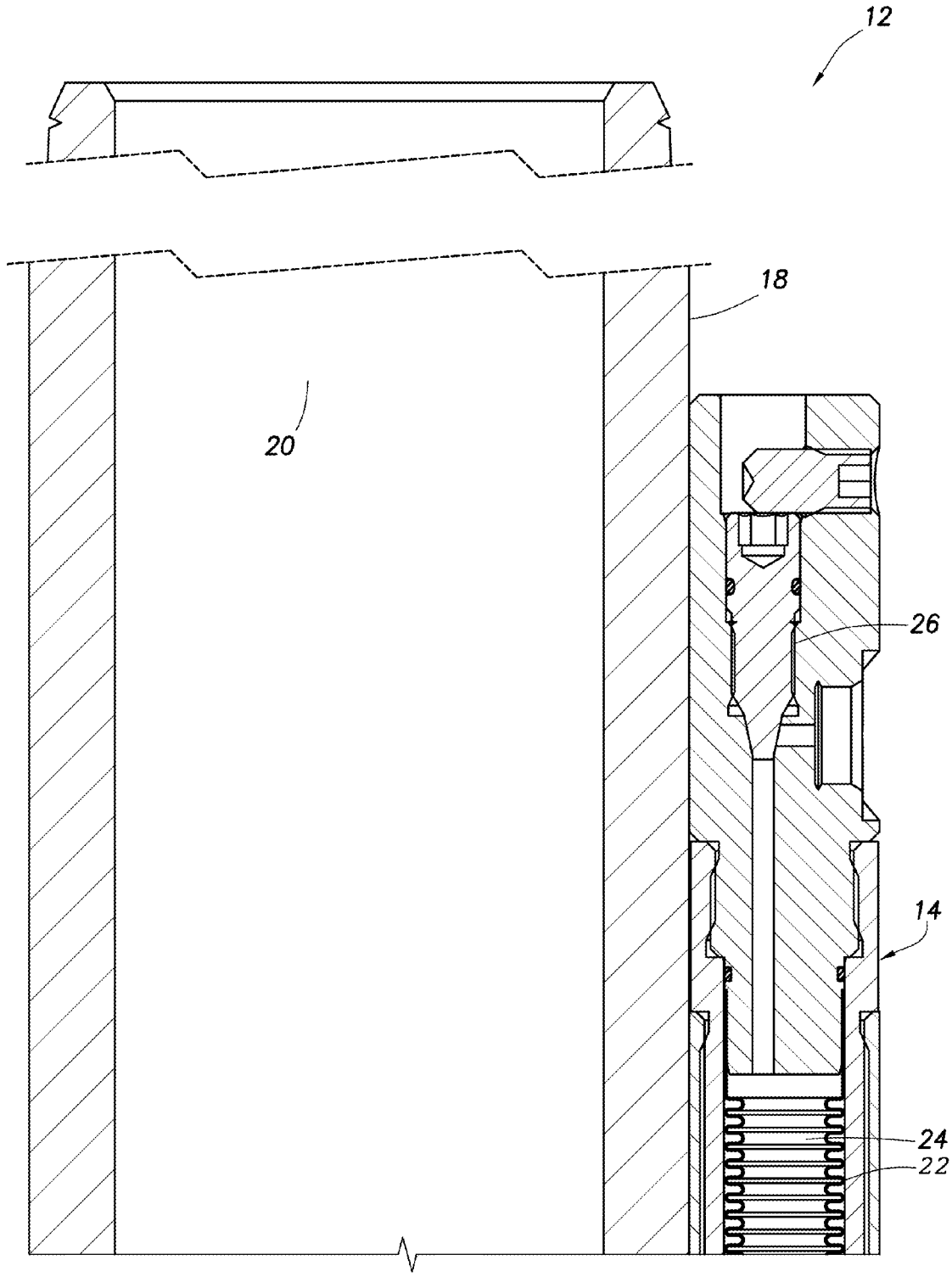
FIGS. 2A-E are successive axial cross-sectional views of a flow control device which may be used in the method, the flow control device embodying principles of the present disclosure.
Figure 2B:
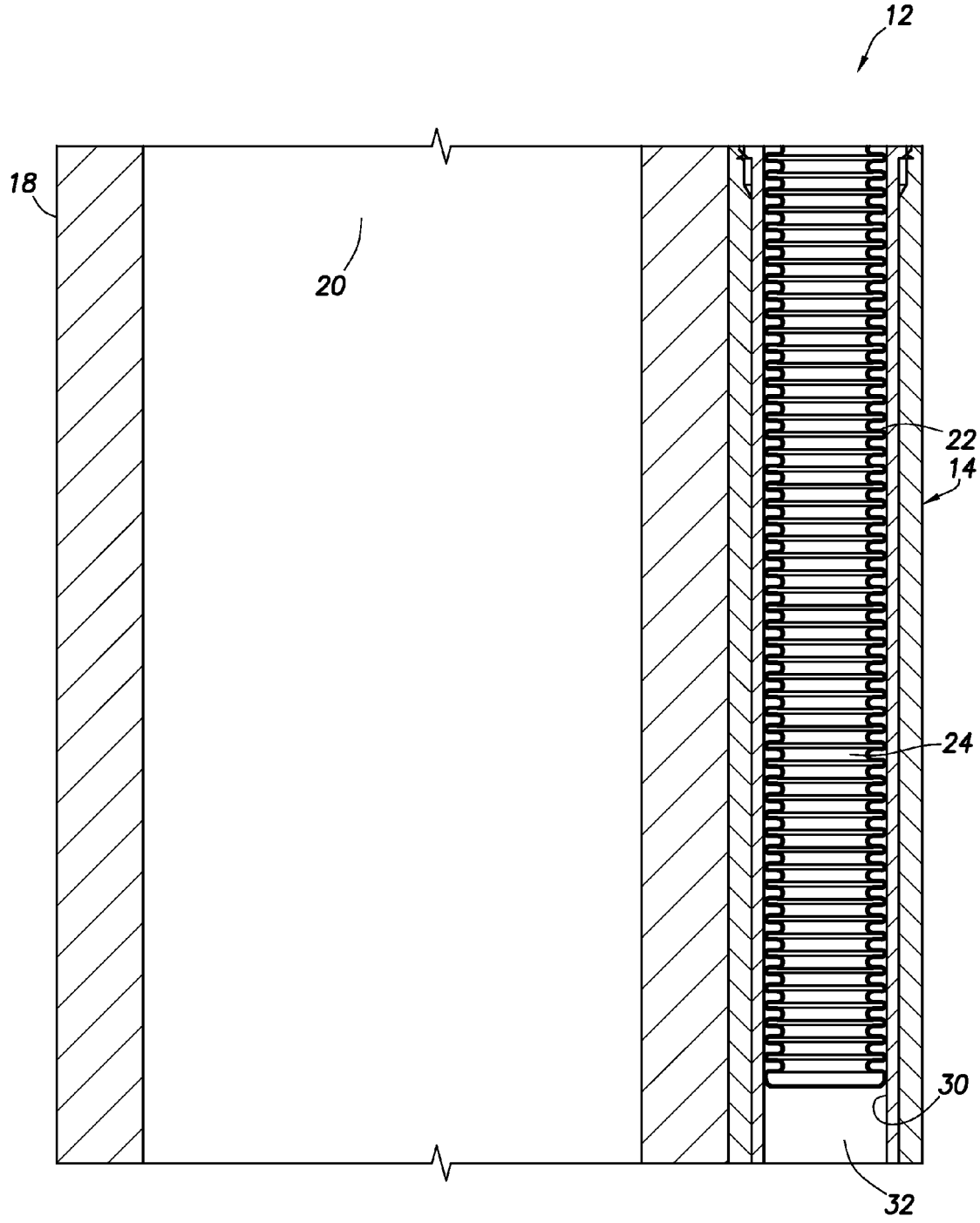
Figure 2C:
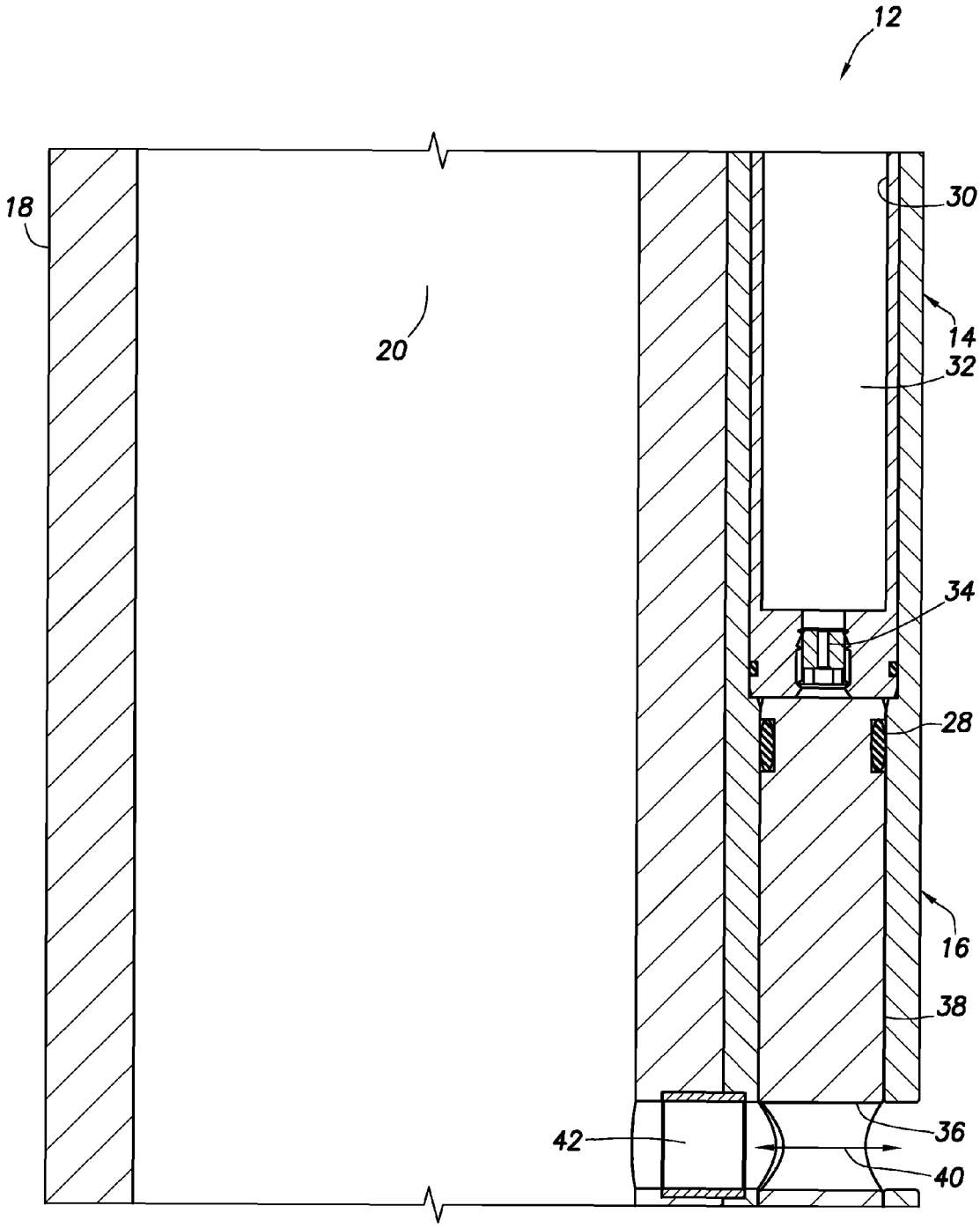
Figure 2D:
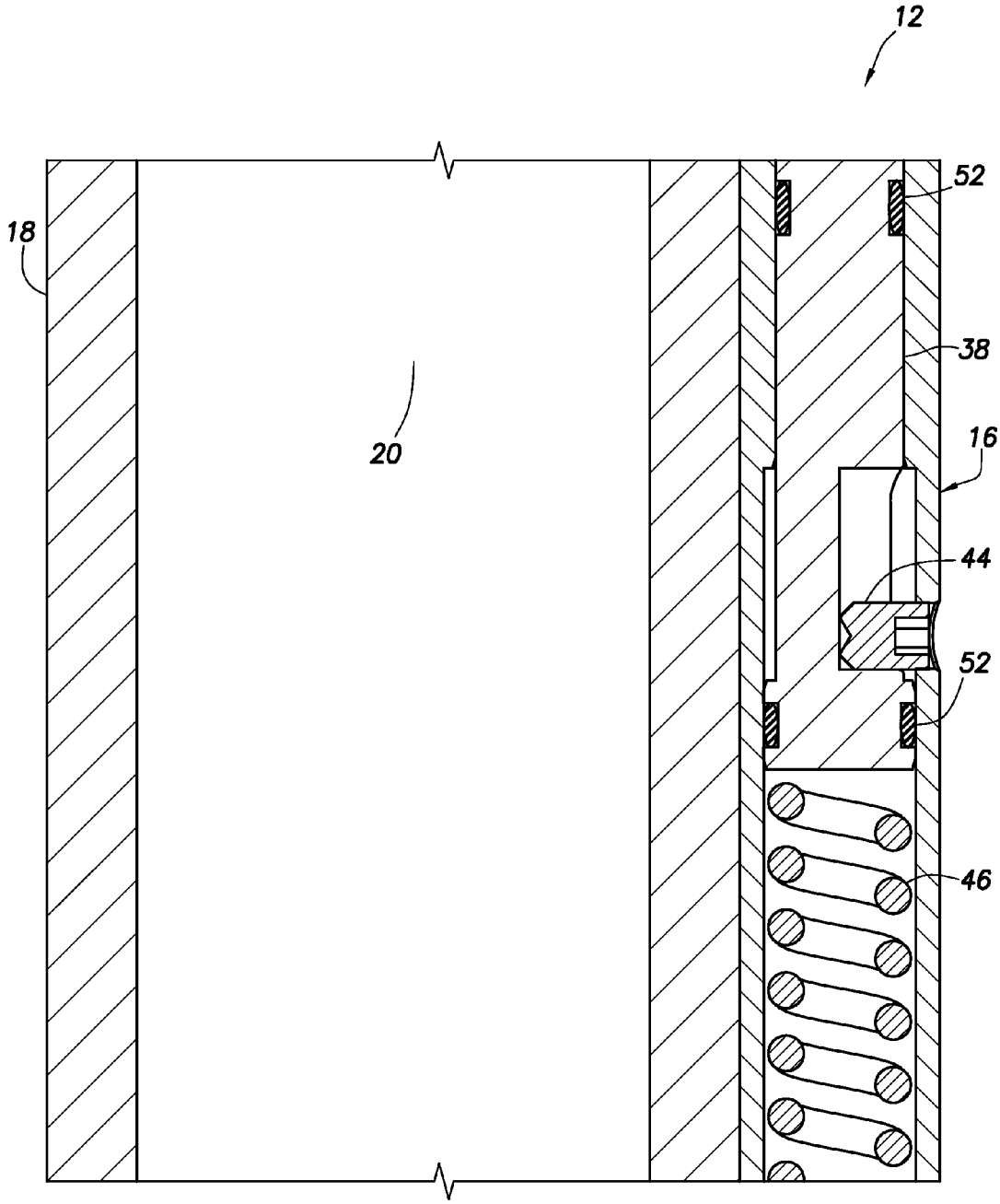
Figure 2E:
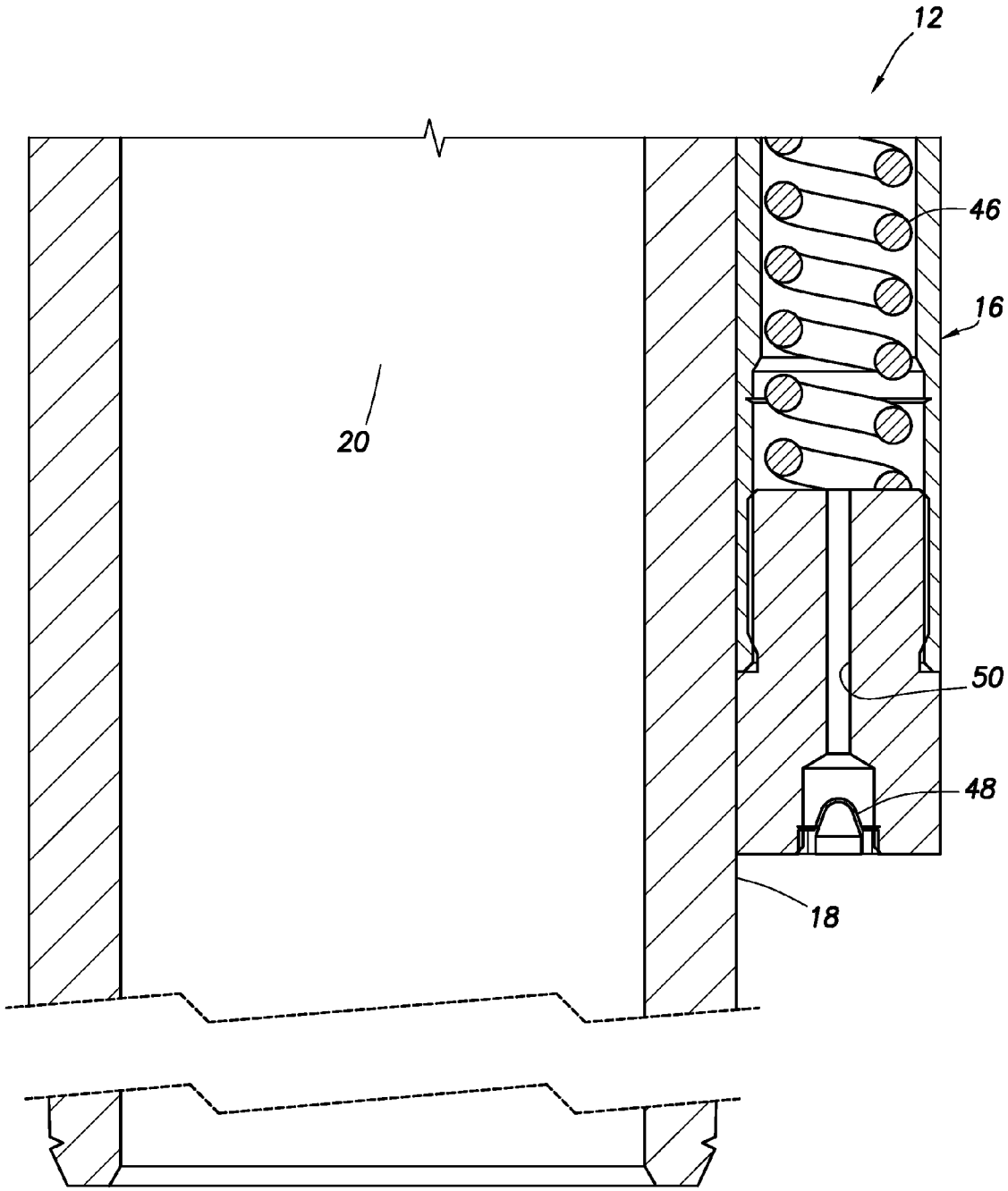

Flow of the fluid 32 downwardly (as depicted in FIG. 2C) through the restrictor 34 causes the piston 28 to displace downwardly, as well. The piston 28 is connected to a port 36 formed through a closure member 38 which is displaceable to prevent, permit or variably restrict flow of a fluid 40 through a passage 42 which intersects the housing passage 20. The passage 20 in this example is used to convey the fluid 40 into a well for injection purposes, or to produce the fluid from a formation.

As depicted in FIG. 2C, the closure member 38 is in an upwardly disposed open position in which relatively unimpeded flow of the fluid 40 is permitted through the passage 42. However, when the piston 28 is downwardly displaced as described above, the closure member 38 will progressively block flow of the fluid 40 through the passage 42, thereby increasingly restricting such flow. If the closure member 38 is displaced downward a sufficient distance, flow of the fluid 40 through the passage 42 can be completely, or at least substantially, prevented.

In addition to the closure member 38, the flow regulator 16 includes a displacement limiter 44, a biasing device 46 and a filter 48 adjacent a pressure equalizing port 50. Seals or debris barriers 52 are carried on the closure member 38 in order to prevent debris from accumulating about the lower portion of the closure member and the biasing device 46, but note that there should be no pressure differential across the barriers 52 during operation of the flow regulator 16.

The biasing device 46 is depicted in the form of a compression spring, but other forms of biasing devices may be used instead. For example, a piston and gas-filled chamber could be used as a biasing device.

The biasing device 46 applies an initial biasing force to the closure member 38 and piston 28 to maintain the closure member in its open position prior to exposing the flow control device 12 to downhole pressures and temperatures during operation of the flow control device. By applying an upward biasing force to the piston 28, a minimum pressure in the fluid 32 is required to initiate downward displacement of the piston and, since the biasing force exerted by the biasing device increases as the downward displacement of the piston increases, a corresponding increase in the pressure in the fluid is required to continue downward displacement of the piston.

An additional upward biasing force is generated by pressure exposed to the flow control device 12 downhole. This downhole pressure acts on the piston 28 to apply the additional biasing force to the fluid 32, thereby increasing the pressure in the fluid as the downhole pressure increases.

The piston 28 in this example is essentially a "floating" piston, in that it serves to transmit pressure from one fluid to another at a 1:1 ratio (except for the additional pressure in the fluid 32 due to the biasing force exerted by the biasing device 46) However, the piston 28 could be designed to produce a pressure multiplying or dividing effect (i.e., at ratios other than 1:1), if desired.

Pressure in the fluid 32 is transmitted to the variable volume chamber 22. As discussed above, increased pressure will produce a decrease in the volume of the chamber 22 and substance 24 therein, and decreased pressure will produce an increase in the volume of the chamber and substance.

In accordance with the principles of the present disclosure, the substance 24 is designed so that its volume varies in a particular manner in response to pressure and temperature exposed to the flow control device 12 downhole. Preferably, the volume of the substance 24 varies to displace the closure member 38 as needed to restrict flow of the fluid 40 through the passage as required to maintain a desired relationship between the phase of the fluid, and the pressure and temperature of the fluid.

As discussed above, this relationship may include maintaining the fluid 40 in its gaseous phase until just prior to its production from a formation. Other desired results may include providing a desired quantitative distribution of steam along an injection wellbore, a desired quantitative distribution of water along a production wellbore, a desired temperature distribution in a formation, a desired steamfront profile in the formation, etc.

Figure 3A:
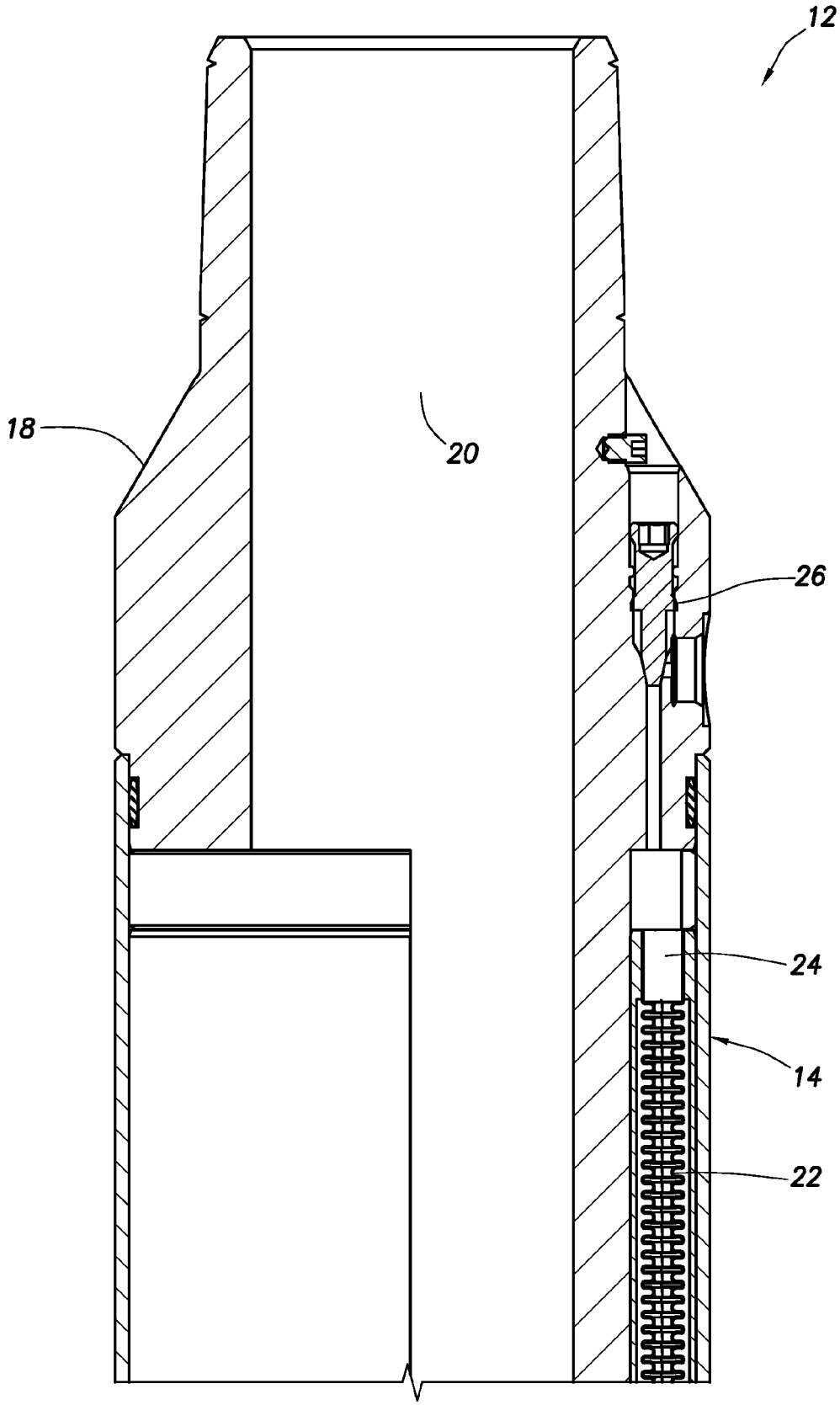
FIGS. 3A-C are successive axial cross-sectional views of a first alternate construction of the flow control device in a closed configuration.
Figure 3B:
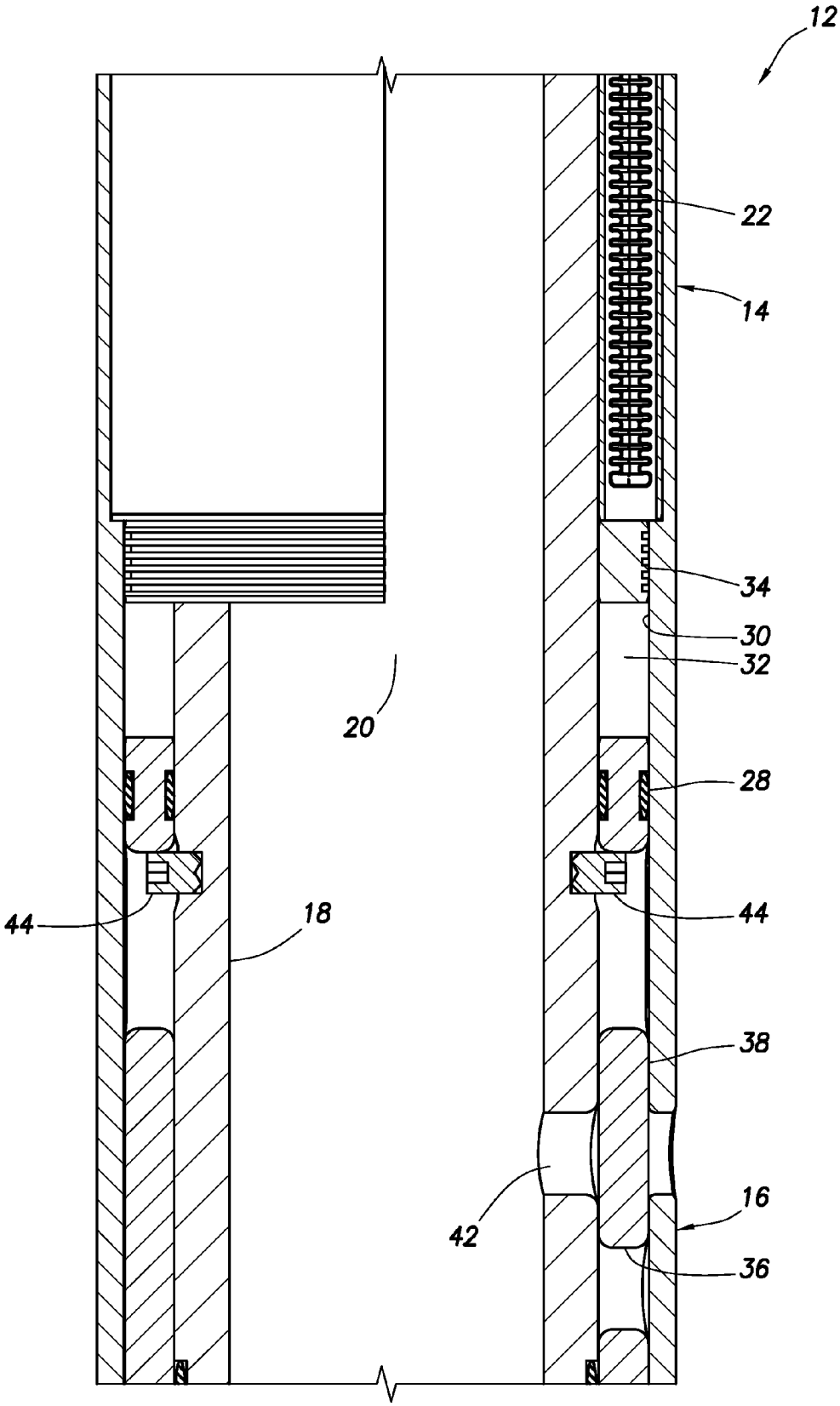
Figure 3C:
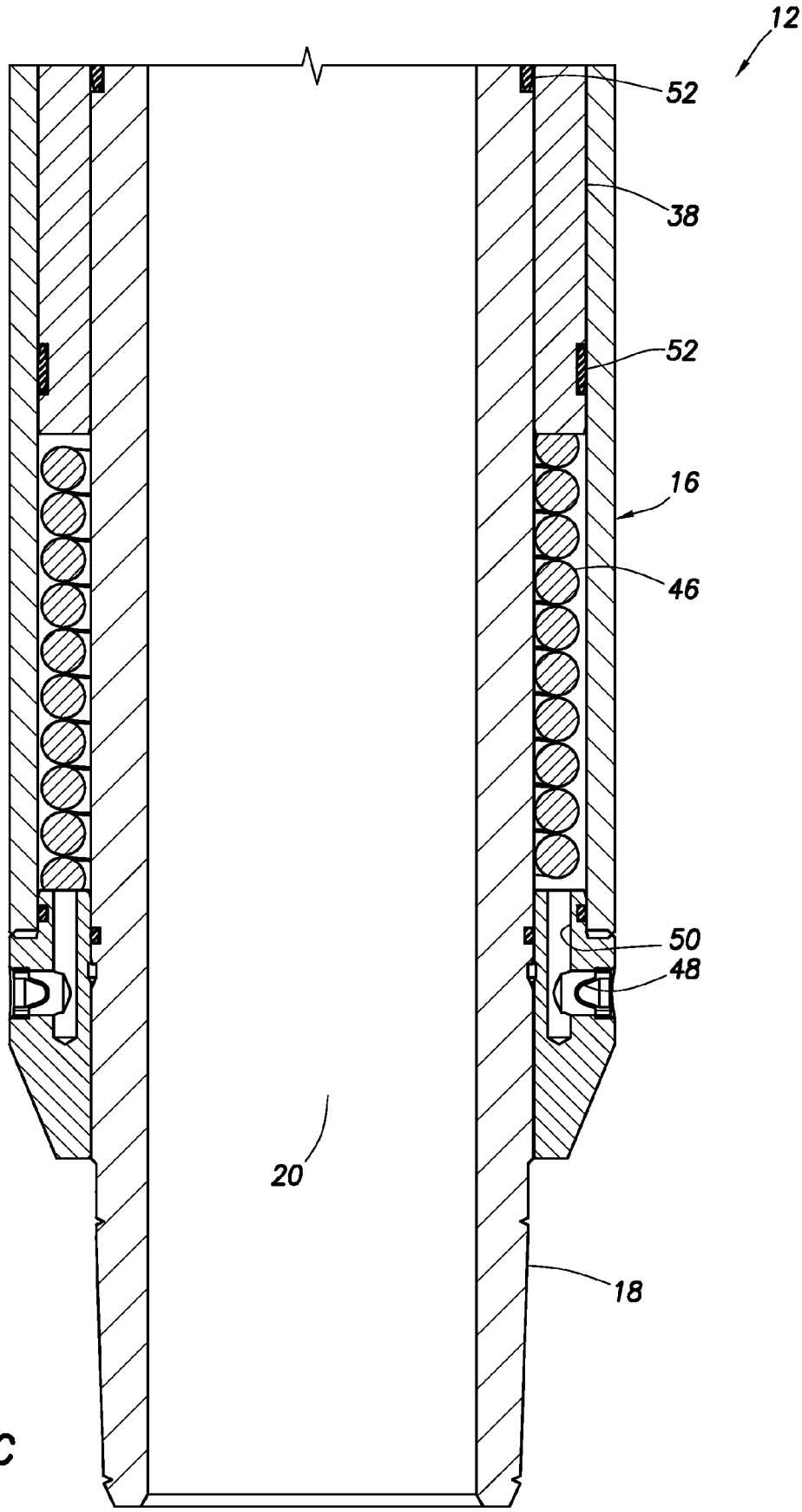
Figure 4A:
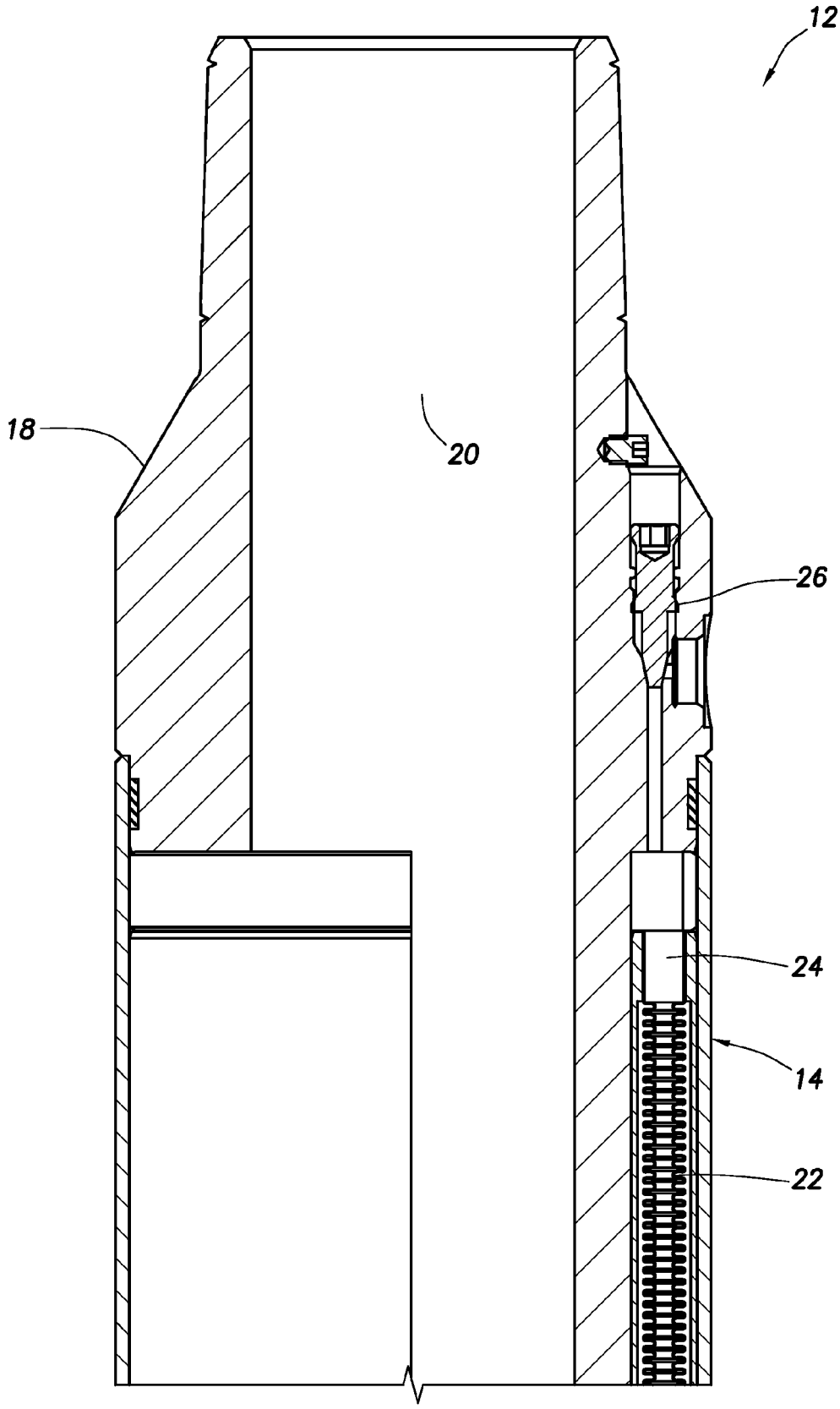
FIGS. 4-C are successive axial cross-sectional views of the first alternate construction of the flow control device in an open configuration.
Figure 4B:
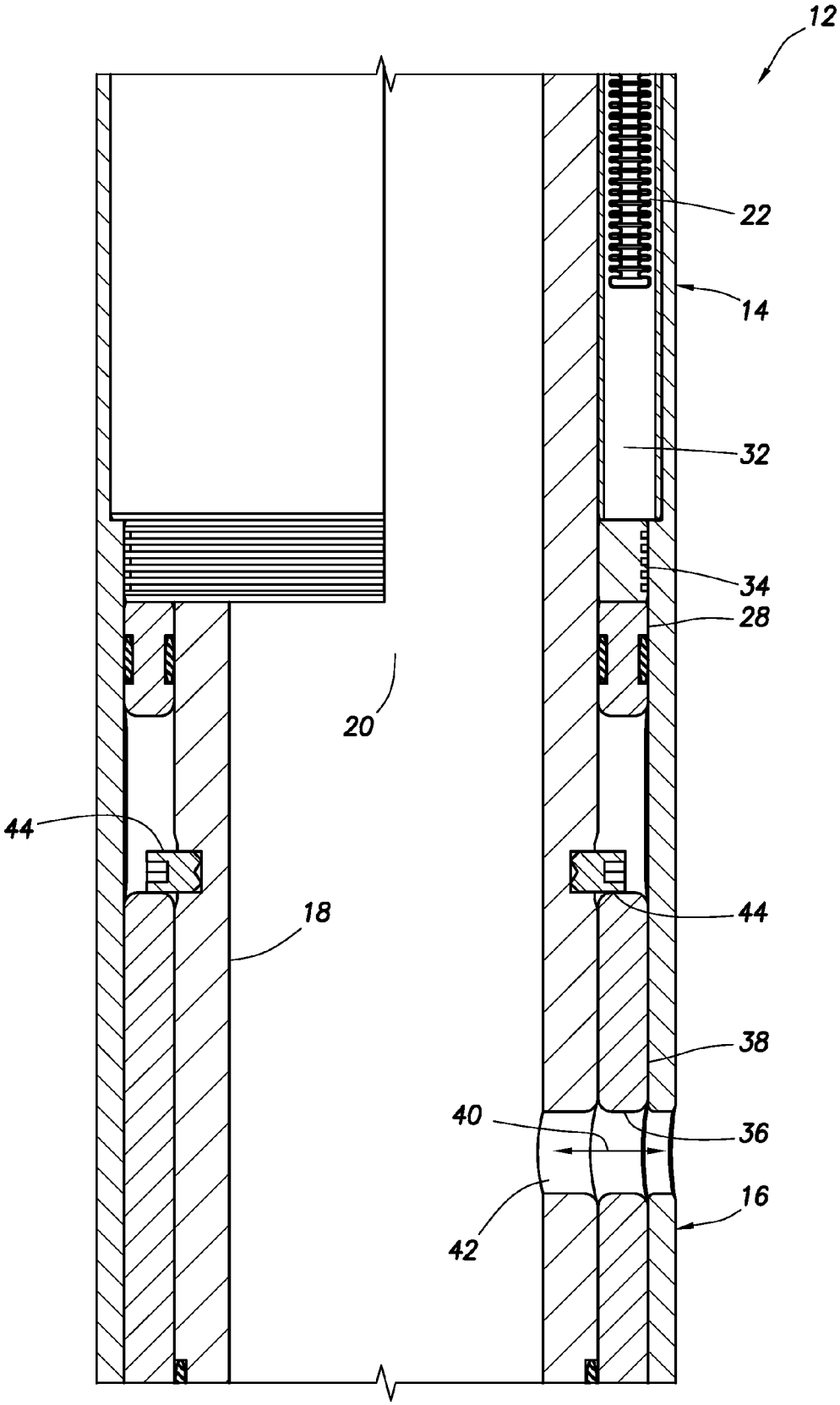
Figure 4C:
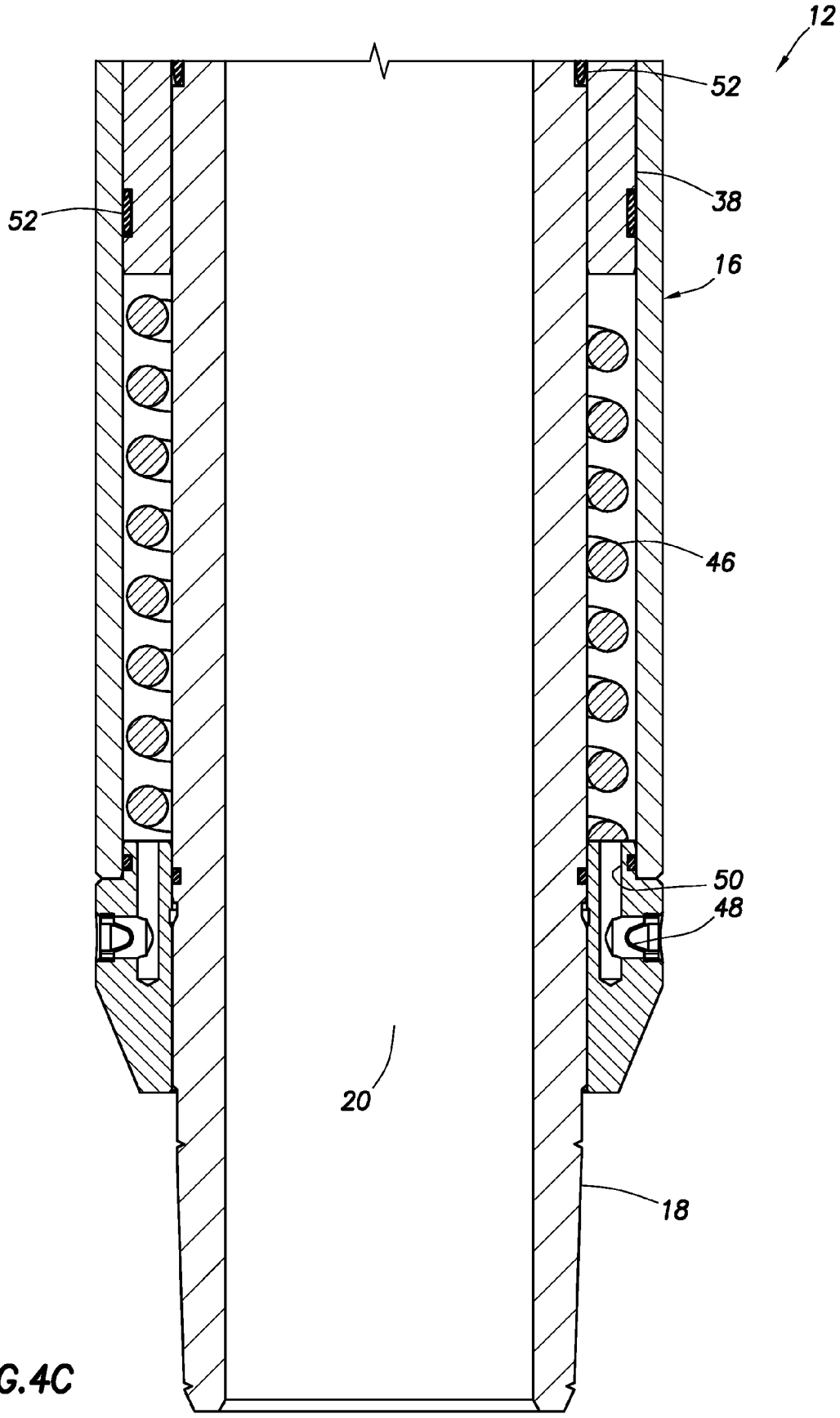

Referring additionally now to FIGS. 3A-C, an alternate construction of the flow control device 12 is representatively illustrated in a closed configuration. In FIGS. 4A-C, this example of the flow control device 12 is representatively illustrated in an open configuration. Elements depicted in FIGS. 3A-C and 4A-C which are functionally equivalent to elements described above for the example of the flow control device 12 of FIGS. 2A-E are indicated in FIGS. 3A-C and 4A-C using the same reference numbers.

The flow control device 12 of FIGS. 3A-C and 4A-C operates essentially the same as in the configuration of FIGS. 2A-E. However, the actuator 14 and flow regulator 16 are in annular form surrounding the housing 18. Another difference is that the flow restrictor 34 is in the form of an annular ring with ridges thereon, instead of an orifice.

FIGS. 3A-C depict the flow control device 12 after the substance 24 and chamber 22 have increased in volume sufficiently to flow the fluid 32 downwardly through the restrictor 34 and downwardly displace the closure member 38 to its fully closed position. Note the difference in volume of the substance 24 and chamber 22 between FIGS. 3A-C and FIGS. 4A-C.

In FIGS. 4A-C, the flow control device 12 is depicted after the substance 24 and chamber 22 have decreased in volume sufficiently to allow flow of the fluid 32 upwardly through the restrictor 34 so that the closure member 38 is upwardly displaced to its fully open position. Of course, the closure member 38 can be displaced to any position between the fully open and closed positions, depending upon the volumes of the substance 24 and chamber 22.

The examples of the flow control device 12 described above can be used in methods of servicing a well which include using one or more of the devices to control the injection of fluid into, or the recovery of fluid from, the well. The well may include one or more wellbores arranged in any configuration suitable for injecting and/or recovering fluid from the wellbores, such as a steam-assisted gravity drainage (SAGD) configuration, a multilateral wellbore configuration, or a common wellbore configuration, etc.

A SAGD configuration typically comprises two independent wellbores with horizontal sections arranged one generally above the other. The upper wellbore may be used primarily to convey steam downhole, and the lower wellbore may be used primarily to produce oil. The wellbores may be positioned close enough together to allow for heat flux from one to the other. Oil in a reservoir adjacent to the upper wellbore becomes less viscous in response to being heated by the steam, such that gravity pulls the oil down to the lower wellbore where it can be produced.

Other suitable gravity drainage configurations use a grid of upper and lower horizontal wellbores which intersect each other. This configuration may be used, for example, to more effectively remove reservoir bitumen. The injection wellbores would still be spaced out above the production wellbores, although not necessarily directly vertically above the production wellbores. Use of the flow control device 12 would alleviate inherent steam distribution problems with this type of gravity drainage configuration.

A multilateral wellbore configuration comprises two or more lateral wellbores extending from a single "parent" wellbore. The lateral wellbores are spaced apart from each other, whereby one wellbore may be used to convey steam downhole and the other wellbore may be used to produce oil. The multilateral wellbores may be arranged in parallel in various orientations (such as vertical or horizontal) and they may be spaced sufficiently apart to allow heat flux from one to the other.

In the common wellbore configuration, a common wellbore may be employed to convey steam downhole and to produce oil. The common wellbore may be arranged in various orientations (such as vertical or horizontal).

Figure 5:
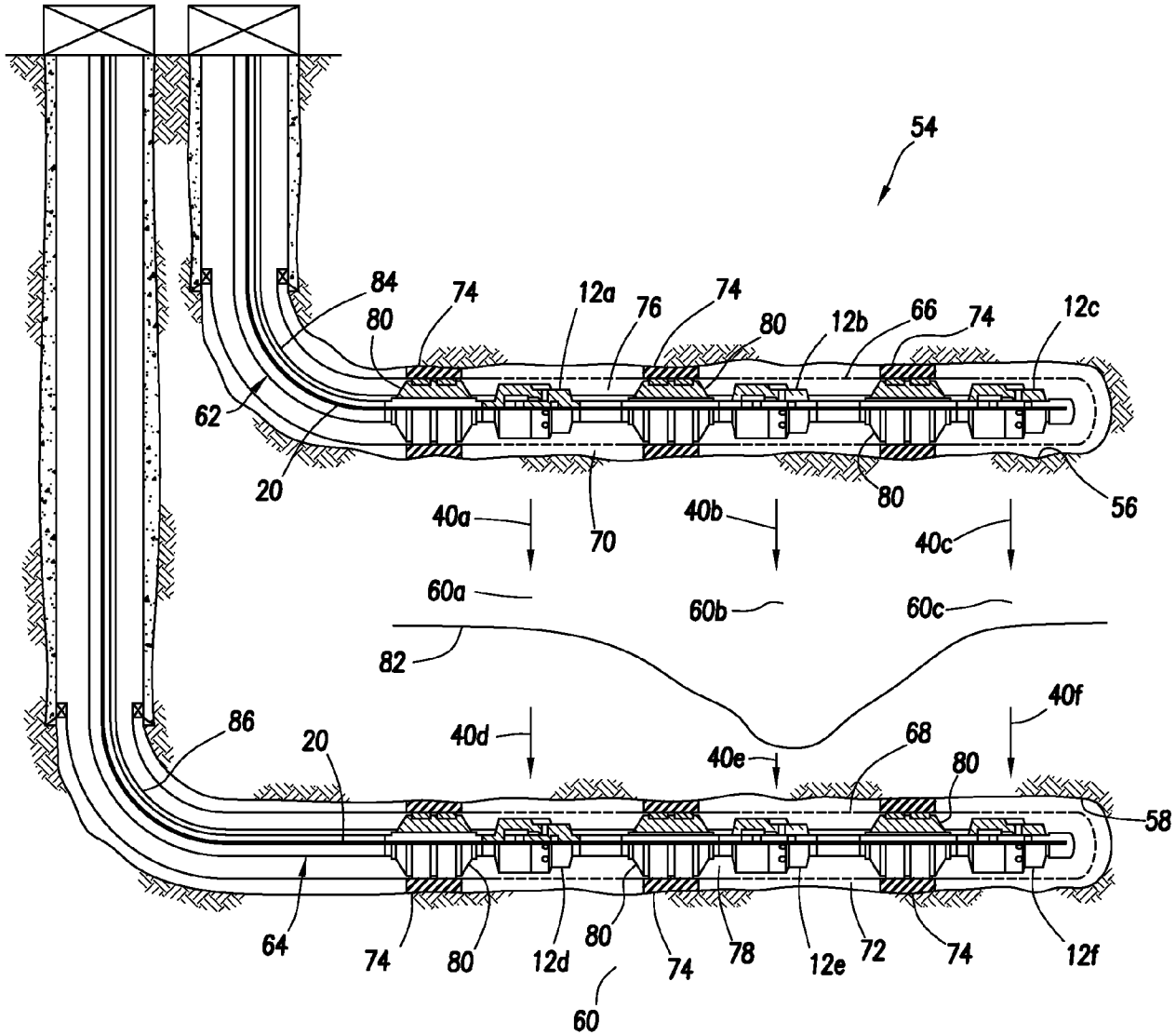
FIG. 5 is a schematic partially cross-sectional view of a well system and associated method which utilize the flow control device and embody principles of the present disclosure.

Referring additionally now to FIG. 5, a well system 54 and associated method of controlling phase change of the fluid 40 in the well system are representatively illustrated. The well system 54 is of the type described above as a steam-assisted gravity drainage (SAGD) system.

The well system 54 includes two wellbores 56, 58. Preferably, the wellbore 58 is positioned vertically deeper in a formation 60 than the wellbore 56. In the example depicted in FIG. 5, the wellbore 56 is directly vertically above the wellbore 5S, but this is not necessary in keeping with the principles of this disclosure.

A set of flow control devices 12*a-c*, 12*d-f* is installed in the respective wellbores 56, 58. The flow control devices 12*a-c*, 12*d-f* are preferably interconnected in respective tubular strings 62, 64 which are installed in respective slotted, screened or perforated liners 66, 68 positioned in open hole portions of the respective wellbores 56, 58.

Although only three of the flow control devices 12*a-c* and 12*d-f* are depicted in each wellbore in FIG. 5, any number of flow control devices may be used in keeping with the principles of the invention. The flow control devices 12*a-c* and 12*d-f* may be any of the flow control devices 12 described herein.

Zones 60*a-c* of the formation 60 are isolated from each other in an annulus 70 between the perforated liner 66 and the wellbore 56, and in an annulus 72 between the perforated liner 68 and the wellbore 58, using a sealing material 74 placed in each annulus. The sealing material 74 could be any type of sealing material (such as swellable elastomer, hardenable cement, selective plugging material, etc.), or more conventional packers could be used in place of the sealing material.

The zones 60*a-c* are isolated from each other in an annulus 76 between the tubular string 62 and the liner 66, and in an annulus 78 between the tubular string 64 and the liner 68, by packers 80 or another sealing material. Note that it is not necessary to isolate the zones 60*a-c* from each other in either of the wellbores 56, 58, and so use of the sealing material 74 and packers 80 is optional.

In the well system 54, steam is injected into the zones 60*a-c* of the formation 60 via the respective flow control devices 12*a-c* in the wellbore 56, and formation fluid (including the injected fluid) is received from the zones into the respective flow control devices 12*d-f* in the wellbore 58. Steam injected into the zones 60*a-c* is represented in FIG. 5 by respective arrows 40*a-c*, and fluid produced from the zones is represented in FIG. 5 by respective arrows 40*d-f*.

The flow control devices 12*a-c*, 12*d-f* in the wellbores 56, 58 are used to control a steamfront profile 82 in the formation 60. The steamfront profile 82 indicates the extent to which the injected fluid 40*a-c* remains in its gaseous phase. By controlling the amount of fluid 40*a-c* injected into each of the zones 60*a-c*, and the amount of fluid 40*d-f* produced from each of the zones, a shape of the profile 82 can also be controlled.

For example, if the steam is advancing too rapidly in one of the zones (as depicted in FIG. 5 by the dip in the profile 82 in the zone 60*b*), the steam injected into that zone may be shut off or choked, or production from that zone may be shut off or choked, to thereby prevent steam breakthrough into the wellbore 58, or at least to achieve a desired shape of the steamfront profile 82.

In the example of FIG. 5, the flow control device 12*b* in the wellbore 56 could be selectively closed or choked to stop or reduce the flow of the steam 40*b* into the zone 60*b*. Alternatively, or in addition, the flow control device 12*e* in the wellbore 58 could be selectively closed or choked to stop or reduce production of the fluid 40*e* from the zone 60*b*.

The flow control devices 12*a-c* and 12*d-f* can be selectively opened, closed, or the restriction to flow through each device selectively varied, in order to maintain the fluid 40*a-c* and 40*d-f* in its gaseous phase until just prior to its production from the formation 60, to provide a desired quantitative distribution of steam along the injection wellbore 56, to provide a desired quantitative distribution of fluid 40*d-f* production along the wellbore 58, and/or to provide a desired temperature distribution in the formation 60, etc.

For example, a method of providing an even quantitative distribution of steam injection along the wellbore 56 could include ceasing the injection operation for a sufficient period of time to allow temperature distribution along the wellbore to stabilize. Zones into which more steam has been injected will then have a greater temperature than zones into which less steam has been injected.

The actuators 14 in the flow control devices 12 will adjust to these temperatures (e.g., the actuators exposed to greater temperature will cause their associated flow regulators 16 to restrict flow therethrough to a greater degree, as compared to the actuators exposed to lesser temperatures). As a result, when steam injection is resumed, those zones which had previously received less steam will now receive a relatively greater quantity of steam, and those zones which had previously received more steam will now receive a relatively lesser quantity of steam, thus balancing steam distribution along the wellbore 56.

As another example, temperature and/or pressure distribution along the wellbores 56, 58 may be monitored using sensors, such as a fiber optic line 84 in the injection wellbore 56 and a fiber optic line 86 in the production wellbore 58. Signals from the sensors may be input to a control module of each actuator 14 (e.g., in the embodiments depicted in FIGS. 10 & 11 and described more fully below), so that each actuator appropriately adjusts its associated flow regulator 16.

Note that the well system 54 is only one of many well systems which may benefit from the principles described in this disclosure. Therefore, it should be clearly understood that the principles of this disclosure are not limited in any way to the details of the well system 54 and its associated method.

For example, it is not necessary for the flow control devices 12*a-c* and 12*d-f* to be used in both of the wellbores 56 and 58. The flow control devices 12*d-f* could be used in the production wellbore 58 without also using the flow control devices 12*a-c* in the injection wellbore 56, and vice versa.

Referring additionally now to FIGS. 6-10, several additional alternative constructions of the flow control device 12 are representatively and schematically illustrated. Elements of the flow control device 12 depicted in FIGS. 6-10 which are functionally similar to elements described above are indicated in FIGS. 6-10 using the same reference numbers.

In each of FIGS. 6-10, the flow regulator 16 is depicted using the generic symbol for a valve. This indicates that the flow regulator 16 may be any type of flow regulating device, including valves (such as ball valves, sliding sleeve valves, needle valves, shuttle valves, pilot valves, etc.), chokes, etc.

The actuator 14 in each of FIGS. 6-10 is connected to the flow regulator 16 via a rod or mandrel 88 such that an upward displacement of the mandrel operates to reduce restriction of flow through the flow regulator, and downward displacement of the mandrel operates to increase restriction of flow through the flow regulator. However, it should be understood that this construction is arbitrary, since the actuator 14 could be connected in any of a wide variety of different ways to the flow regulator 16, and other types and directions of displacements can be used to increase or decrease restriction to flow through the flow regulator.

Figure 6:
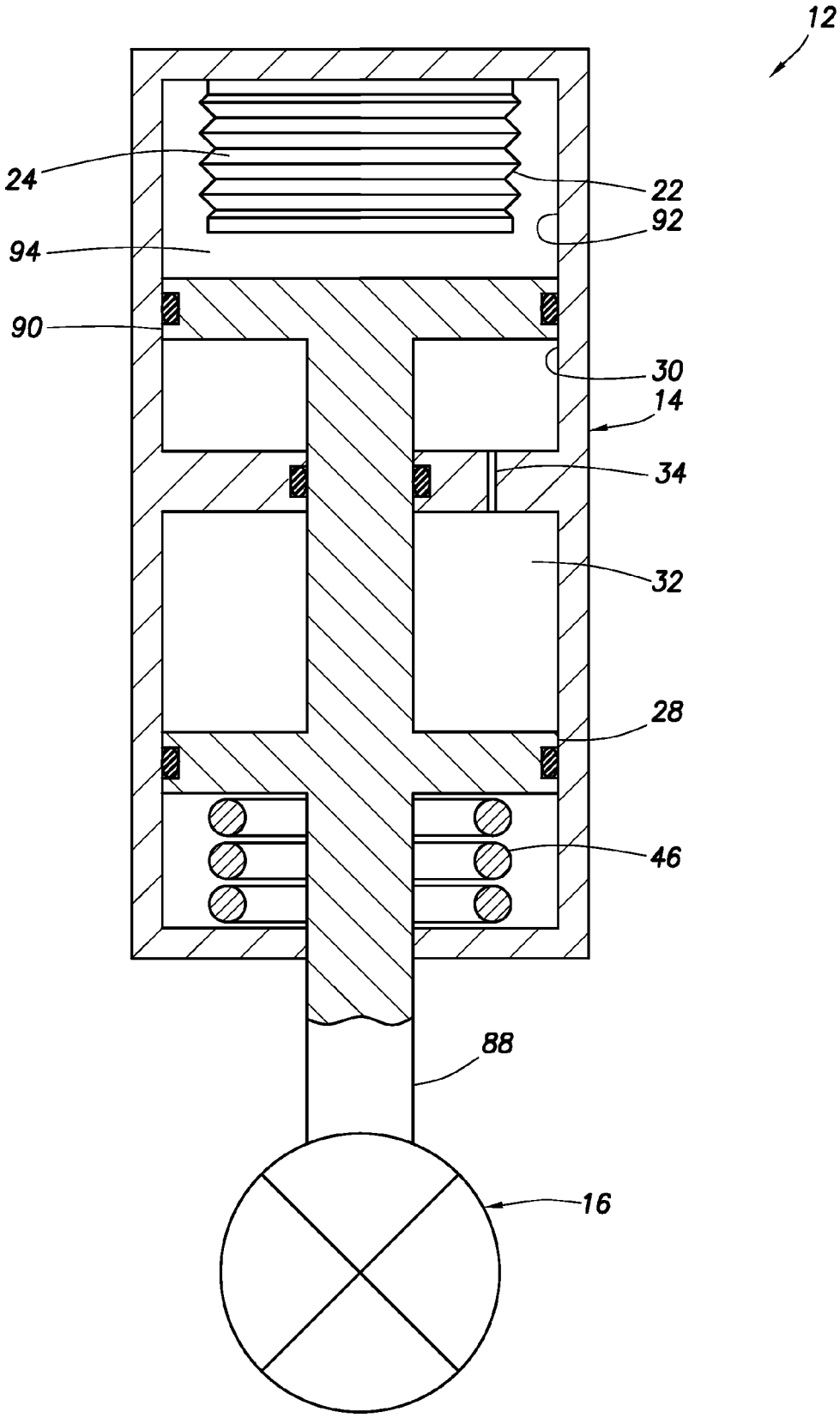
FIG. 6 is a schematic cross-sectional view of a second alternate construction of the flow control device.
Figure 7:
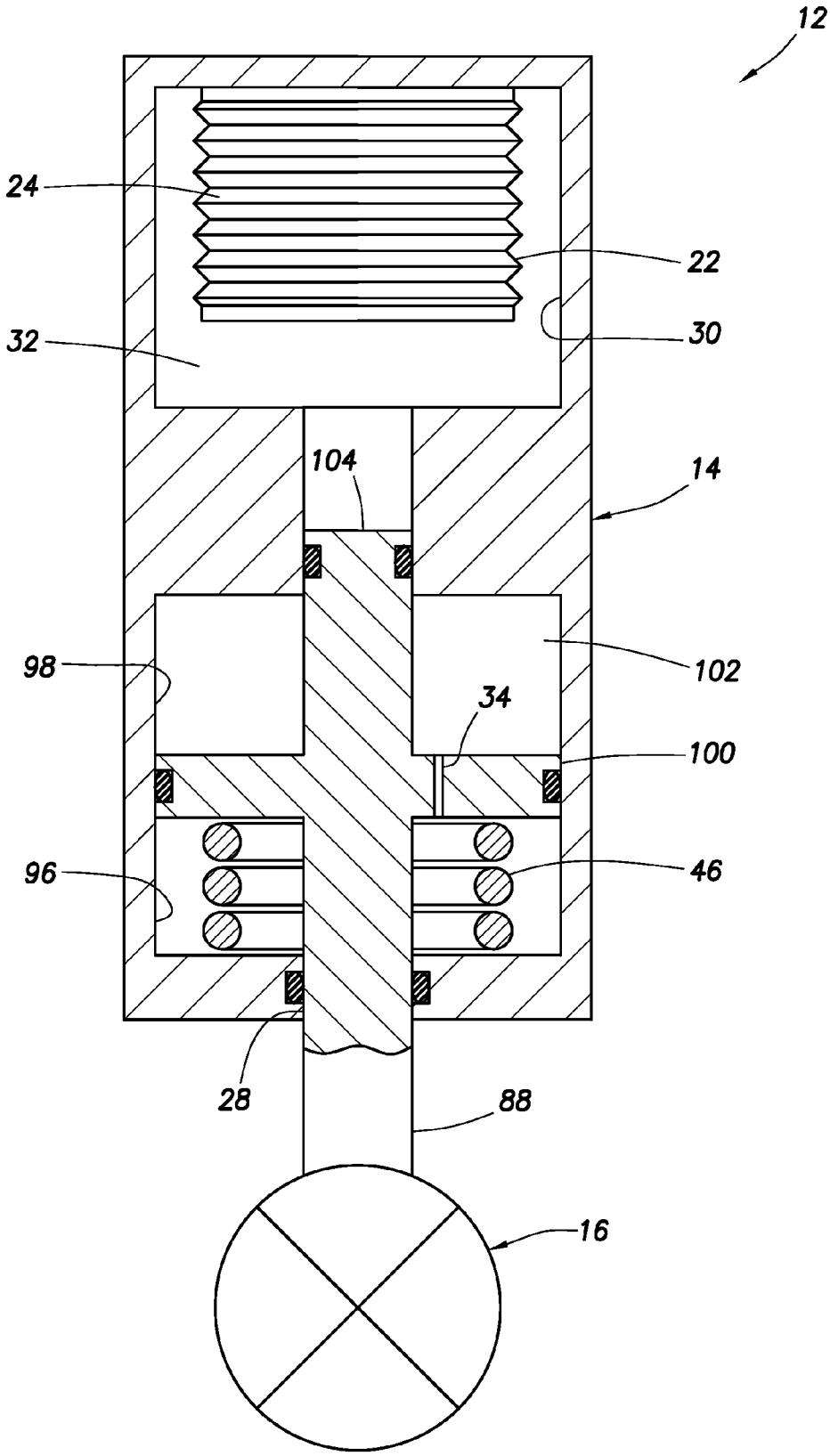
FIG. 7 is a schematic cross-sectional view of a third alternate construction of the flow control device.

The configuration of FIG. 6 is similar in many respects to the configuration of FIGS. 2A-E. However, in the configuration of FIG. 6, an additional floating piston 90 is interposed between the chamber 30 and another chamber 92 in which the substance 24 and variable volume chamber 22 are contained. A suitable temperature-stable and relatively incompressible fluid 94 (such as a hydraulic oil, etc.) is contained in the chamber 92 surrounding the chamber 22 and separating the chamber 22 from the piston 90.

The configuration of FIG. 7 is again similar in many respects to the configuration of FIGS. 2A-E & 6. However, in the configuration of FIG. 7, the piston 28 which applies compression to the substance 24 and chamber 22 in response to pressure exposed to the actuator 14 is positioned below the biasing device 46. In addition, the biasing device 46 is contained in a chamber 96 separated from another chamber 98 by a floating piston 100.

The flow restrictor 34 is carried on the piston 100 so that, as the piston 100 and mandrel 88 displace, a fluid 102 (such as a suitable hydraulic fluid, etc.) is transferred between the chambers 96, 98 via the restrictor, thereby damping the displacement. Variation in the volume of the substance 24 and chamber 22 is transferred via the fluid 32 in the chamber 30 to corresponding displacement of a piston 104 connected to the piston 100 and mandrel 88.

Figure 8:
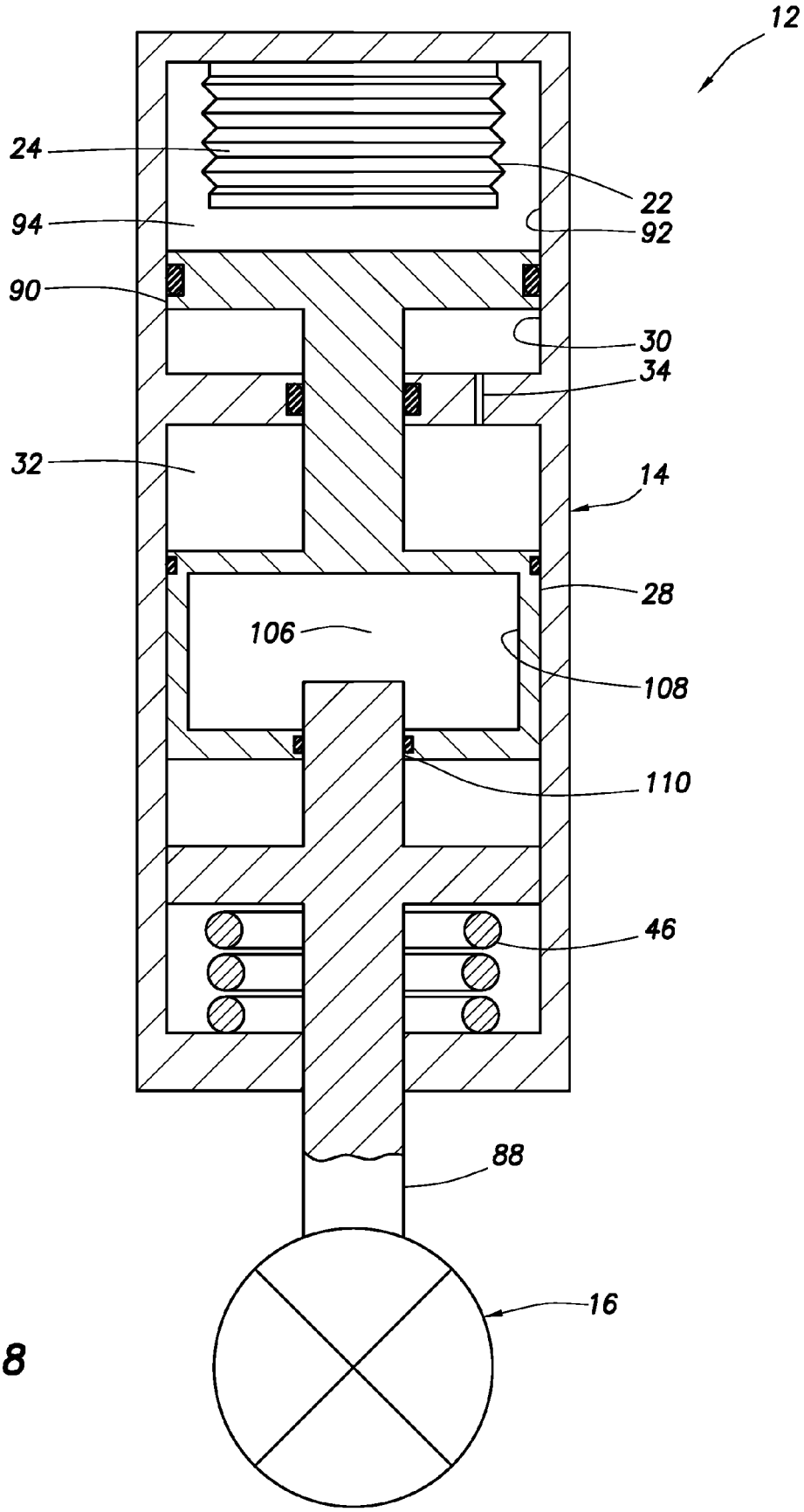
FIG. 8 is a schematic cross-sectional view of a fourth alternate construction of the flow control device.

The configuration of FIG. 8 is similar in many respects to the configuration of FIG. 6. However, in the configuration of FIG. 8, an additional substance 106, variable volume chamber 108 and piston 110 are interposed between the biasing device 46 and the piston 28. In addition, the variable volume chamber 108 is integrally formed with the piston 28.

In one embodiment, the substance 106 may be the wax material described above. The wax material may not change volume appreciably in response to changes in pressure applied thereto, but the wax material may change volume substantially in response to changes in temperature.

As the volume of the substance 106 increases the piston 110 is displaced downwardly, and as the volume of the substance decreases the piston is displaced upwardly. Thus, in combination with the displacement of the piston 28 in response to changes in volume of the substance 24 and chamber 22 as described above, this displacement of the piston 110 can be used to adjust or refine the response of the actuator 14 to pressures and temperatures exposed thereto downhole. In this manner, for example, a predetermined relationship between the phase of the fluid 40 and the temperature and pressure exposed to the actuator 14 may be more accurately maintained.

Figure 9:
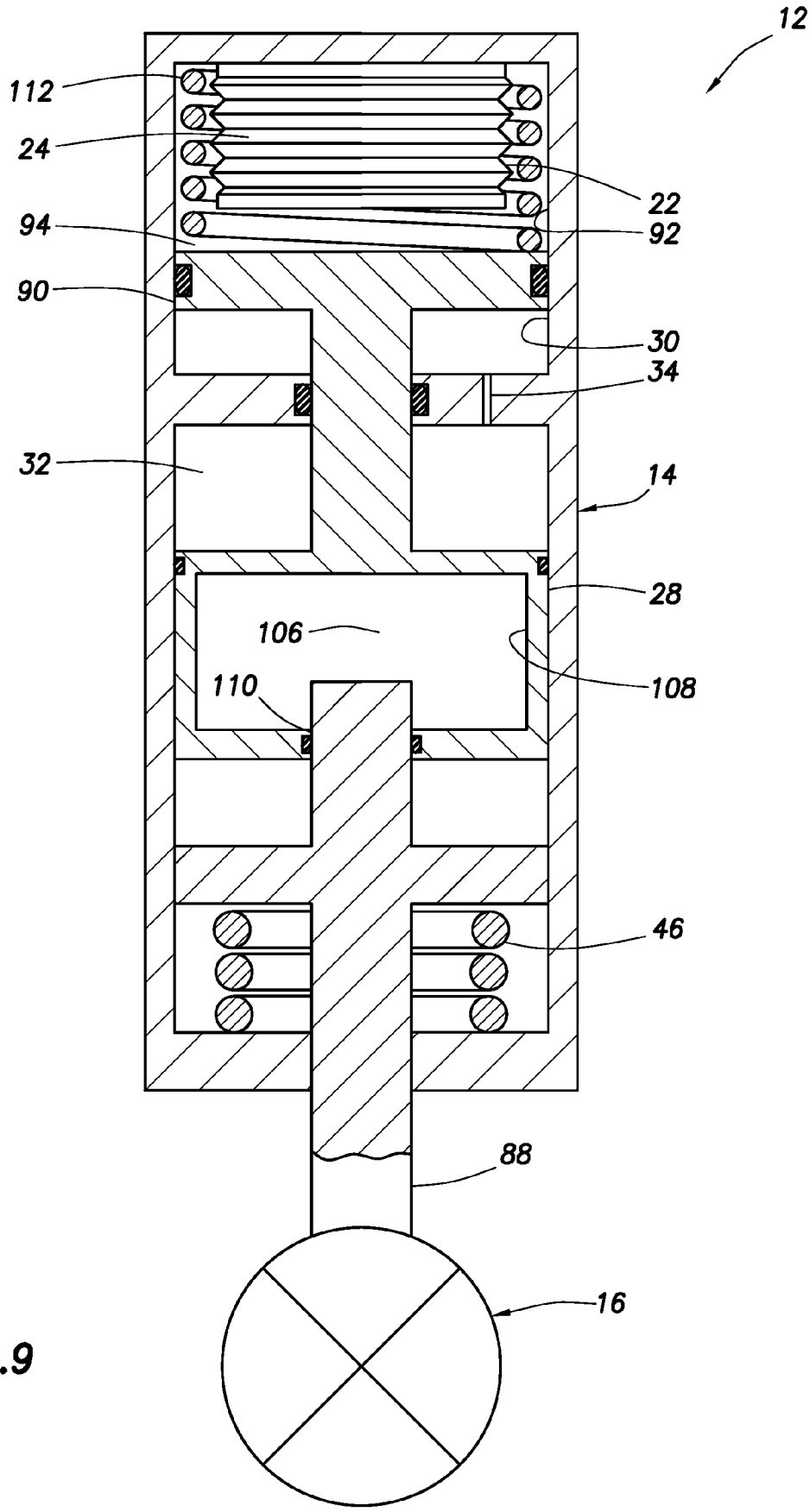
FIG. 9 is a schematic cross-sectional view of a fifth alternate construction of the flow control device.

The configuration of FIG. 9 is very similar to the configuration of FIG. 8. However, in the configuration of FIG. 9, the substance 24 is maintained at a lower pressure due to a downward biasing force exerted on the piston 90 by a biasing device 112 contained in the chamber 92. Depending upon the composition of the substance 24, a lower pressure may be desirable in order to adjust or refine the response of the actuator 14 to pressures and temperatures exposed thereto downhole. In this manner, for example, a predetermined relationship between the phase of the fluid 40 and the temperature and pressure exposed to the actuator 14 may be more accurately maintained.

Figure 10:
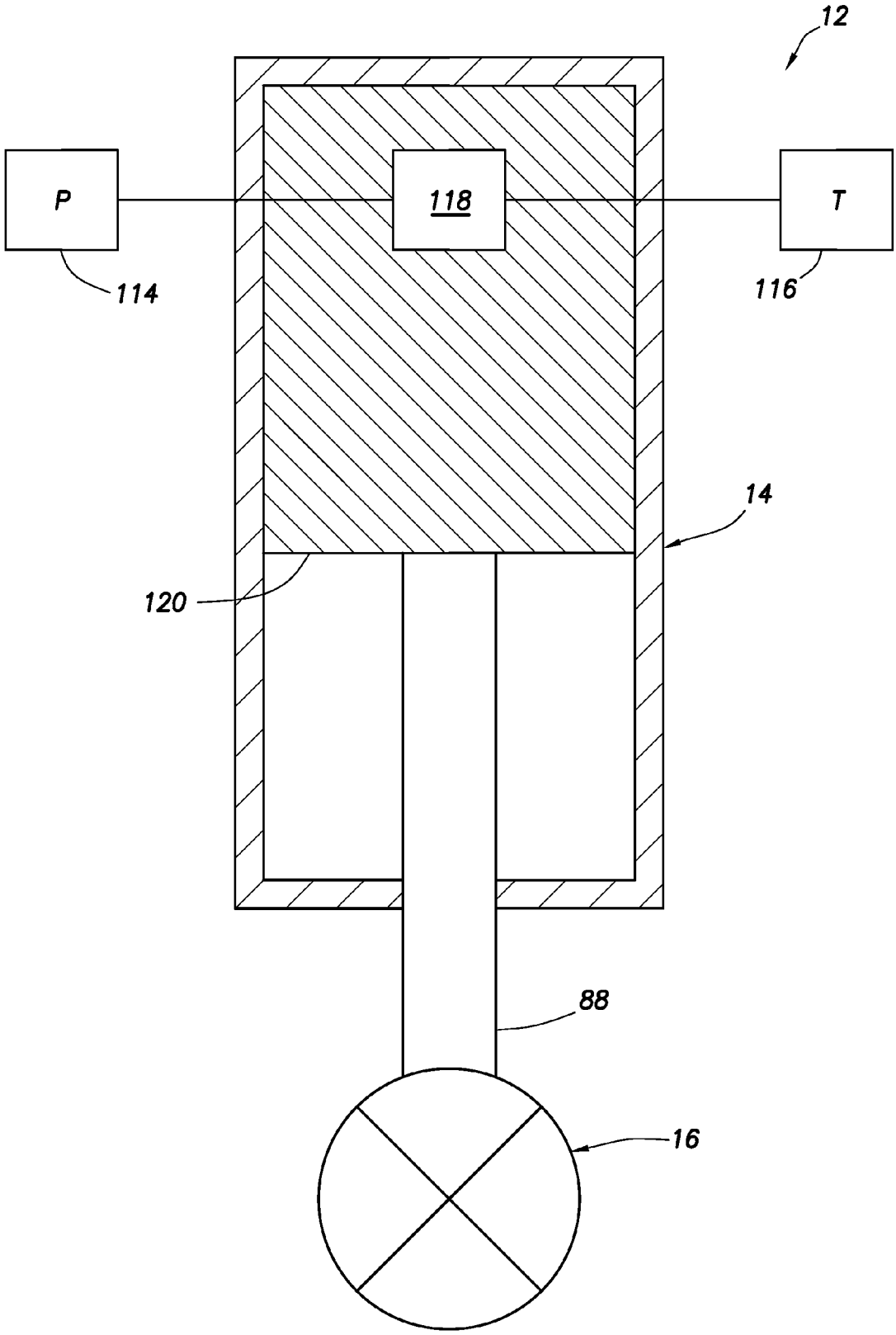
FIG. 10 is a schematic cross-sectional view of a sixth alternate construction of the flow control device.

The configuration of FIG. 10 is substantially different from the other configurations described above. Instead of the substance 24 and various chambers 22, etc. and pistons 28, etc. of the other configurations, the configuration of FIG. 10 is responsive to signals received from a pressure sensor 114 and a temperature sensor 116 connected to the actuator 14. Alternatively, the pressure and temperature sensors 114, 116, or either of them, could be incorporated into the actuator 14 itself.

Signals from the pressure and temperature sensors 114, 116 are received by a control module 118 of the actuator 114. The control module 118 could, for example, include a microprocessor, random access and/or read-only memory, and programming to appropriately control operation of the actuator 14 in response to the sensed pressure and temperature. Electrical power for the control module 118 may be supplied by downhole batteries, generated downhole, or delivered via electrical or fiber optic line from a remote location, etc.

The pressure and temperature sensors 114, 116 may be separate or combined into a single sensor assembly. For example, the pressure and temperature sensors 114, 116 could both use the fiber optic line 84 and/or 86 (see FIG. 5 and accompanying description above) as a sensing element.

Command signals from the control module 118 are used to control a displacement device 120 of the actuator 14. The displacement device 120 could, for example, be an electric, mechanical, hydraulic, electromechanical, or other type of displacement regulating device which is operative to displace the mandrel 88 and thereby vary a restriction of flow of the fluid 40 through the flow regulator 16. The control module 118 is, thus, effective to control the response of the actuator 14 to pressures and temperatures exposed thereto downhole. In this manner, for example, a predetermined relationship between the phase of the fluid 40 and the temperature and pressure exposed to the actuator 14 may be more accurately maintained.

Figure 11:
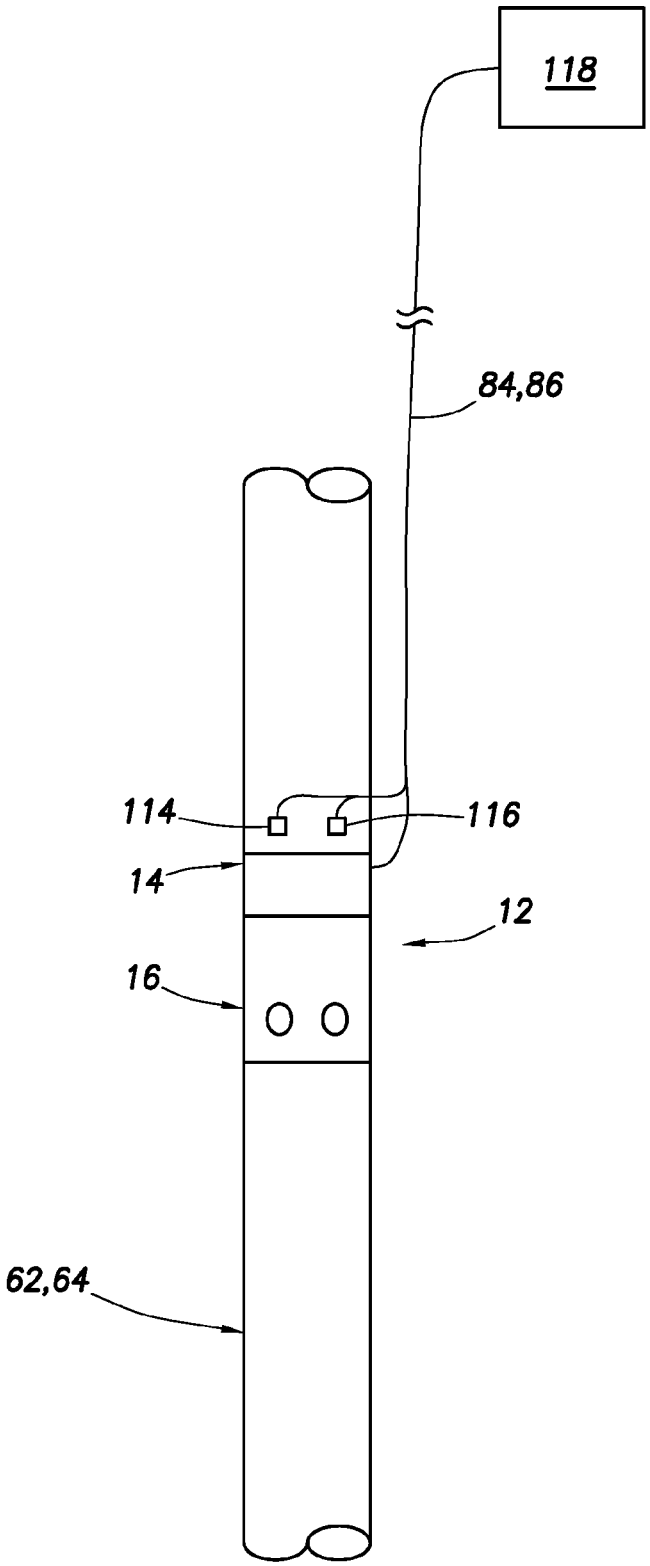
FIG. 11 is a schematic elevational view of the flow control device sixth construction having a remotely located control module.

Note that it is not necessary for the control module 118 to be contained in the actuator 14, or even in the flow control device 12. Instead, as depicted in FIG. 11, the control module 118 could be positioned at a remote location, such as the earth's surface, a subsea tree, etc.

Signals from the sensors 114, 116 could be transmitted to the control module 118 via the lines 84, 86 (which could be fiber optic or any other type or combination of lines) or via any form of telemetry. Control signals from the control module 118 could be transmitted to the actuator 114 via the lines 84, 86 or any form of telemetry.

In this manner, the electronic circuitry of the control module 118 can be located away from the high temperatures and pressures of the downhole environment, while still retaining the capability of accurately maintaining a predetermined relationship between the phase of the fluid 40 and the temperature and pressure exposed to the actuator 14 downhole. This feature is particularly beneficial if the flow control device 12 is to be installed in a steam injection well, e.g., the wellbore 56 described above.

As in the example of FIG. 10 described above, the pressure and temperature sensors 114, 116 could be separate sensors or combined into a single sensor. The sensors 114, 116 could, for example, be fiber optic sensors which are part of the line 84 or 86. The sensors 114, 116 could be located in or on the tubular string 62 or 64, or could be located elsewhere in the well.

It may now be fully appreciated that the above disclosure provides several significant benefits to the art of controlling flow of fluid and a phase of the fluid in a well environment. In particular, by using the phase of the fluid as a basis for controlling flow of the fluid, many advantages can be obtained in well systems and associated methods.

A person skilled in the art will appreciate that the above disclosure provides a well system 54 which includes a flow control device 12 which regulates flow of a fluid 40 in the well system. The flow control device 12 is responsive to both pressure and temperature in the well system 54 to regulate flow of the fluid 40.

The flow control device 12 may include an actuator 14 including a substance 24, 106, and a volume of the substance may vary in response to both of the pressure and temperature in the well system 54. The substance 24, 106 volume may vary according to a predetermined relationship between a phase of the fluid 40 and both of the pressure and temperature in the well system 54.

The actuator 14 may include a control module 118 which is connected to a pressure sensor 114 and a temperature sensor 116, and the control module may control actuation of the actuator according to a predetermined relationship between a phase of the fluid 40 and both of the pressure and temperature in the well system 54 as sensed by the pressure and temperature sensors.

The flow control device 12 may be positioned in a wellbore 58 into which the fluid 40 flows from a subterranean formation 60. The flow control device 12 may be positioned in a wellbore 56 from which the fluid 40 flows into a subterranean formation 60.

The pressure and temperature to which the flow control device 12 is responsive may be in a wellbore 56, 58 in which the flow control device is positioned.

A flow control device 12 for use in a subterranean well system 54 is also provided by the above disclosure. The flow control device 12 includes a flow regulator 16 for regulating flow of a fluid 40 through the flow control device in the well system 54, and an actuator 14 which is operative to actuate the flow regulator in response to a predetermined relationship between a phase of the fluid and both pressure and temperature exposed to the actuator in the well system.

The actuator 14 may include a substance 24, 106 and a piston 28, 110 which is operative to apply compression to the substance. The substance 24, 106 may have a volume which varies in response to a level of the compression applied by the piston 28, 110. The substance 24 may comprise an azeotrope. The substance 24, 106 volume may also vary in response to the temperature exposed to the actuator 14 in the well system 54. The piston 28, 110 may apply the compression to the substance 24, 106 in response to the pressure exposed to the actuator 14 in the well system 54.

A method of controlling a phase change of a fluid 40 in a well system 54 is also provided by the above disclosure. The method includes the steps of: flowing the fluid 40 through a flow control device 12 in the well system 54, and adjusting the flow control device in response to both pressure and temperature in the well system.

The adjusting step may include adjusting the flow control device 12 so that the phase change of the fluid 40 occurs at a predetermined location in the well system 54. The flowing step may include flowing the fluid 40 from the flow control device 12 to the predetermined location. The flowing step may include flowing the fluid 40 from the predetermined location to the flow control device 12.

The adjusting step may be automatically performed in response to the pressure and temperature in the well system 54, without human intervention.

The flow control device 12 may be one of multiple flow control devices 12*a-f* in the well system 54, and the adjusting step may include regulating a phase change profile 82 of the fluid 40 in a subterranean formation 60 by adjusting flow of the fluid through each of the multiple flow control devices.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a flow control device which regulates flow of a first fluid in the well system;

wherein the flow control device is responsive to both pressure and temperature in the well system to regulate flow of the first fluid;

wherein the flow control device comprises an actuator including a substance, and wherein a volume of the substance varies in response to both of the pressure and temperature in the well system;

wherein a change in volume of the substance displaces a second fluid; and wherein a closure member displaces in response to displacement of the second fluid.

2. The system of claim 1, wherein the change in volume of the substance forces the second fluid through a flow restrictor which prevents rapid displacements of the closure member.

3. The system of claim 1, wherein the substance volume varies according to a predetermined relationship between a phase of the first fluid and both of the pressure and temperature in the well system.

4. The system of claim 1, wherein the flow control device comprises an actuator including a control module which is connected to a pressure sensor and a temperature sensor, and wherein the control module controls actuation of the actuator according to a predetermined relationship between a phase of the first fluid and both of the pressure and temperature in the well system as sensed by the pressure and temperature sensors.

5. The system of claim 1, wherein the flow control device is positioned in a wellbore into which the first fluid flows from a subterranean formation.

6. The system of claim 1, wherein the flow control device is positioned in a wellbore from which the first fluid flows into a subterranean formation.

7. The system of claim 1, wherein the pressure and temperature are in a wellbore in which the flow control device is positioned.

8. A flow control device for use in a subterranean well system, comprising:

a flow regulator for regulating flow of a first fluid through the flow control device in the well system; and an actuator which is operative to actuate the flow regulator in response to a predetermined relationship between a phase of the first fluid and both pressure and temperature exposed to the actuator in the well system;

wherein the actuator includes a substance, and wherein a volume of the substance varies in response to both of the pressure and temperature in the well system;

wherein a change in volume of the substance displaces a second fluid; and wherein a closure member displaces in response to displacement of the second fluid.

9. The device of claim 8, wherein the actuator includes a piston which is operative to apply compression to the substance.

10. The device of claim 9, wherein the substance has a volume which varies in response to a level of the compression applied by the piston.

11. The device of claim 9, wherein the substance comprises an azeotrope.

12. The device of claim 9, wherein the change in volume of the substance forces the second fluid through a flow restrictor which prevents rapid fluctuations of the piston.

13. The device of claim 9, wherein the piston applies the compression to the substance in response to the pressure exposed to the actuator in the well system.

14. The device of claim 8, wherein the actuator includes a control module which is connected to a pressure sensor and a temperature sensor, and wherein the control module controls actuation of the actuator according to a predetermined relationship between the phase of the first fluid and both of the pressure and temperature in the well system as sensed by the pressure and temperature sensors.

15. A method of controlling a phase change of a first fluid in a well system, the method comprising the steps of:

flowing the first fluid through a flow control device in the well system; and adjusting the flow control device in response to both pressure and temperature in the well system, wherein a change in at least one of the pressure and temperature causes:

a) a change in volume of a substance in an actuator, b) a second fluid to displace in response to the change in volume of the substance, and c) a closure member to displace in response to displacement of the second fluid.

16. The method of claim 15, wherein the adjusting step further comprises adjusting the flow control device so that the phase change of the first fluid occurs at a predetermined location in the well system.

17. The method of claim 16, wherein the flowing step further comprises flowing the first fluid from the flow control device to the predetermined location.

18. The method of claim 16, wherein the flowing step further comprises flowing the first fluid from the predetermined location to the flow control device.

19. The method of claim 15, wherein the adjusting step is automatically performed in response to the pressure and temperature in the well system, without human intervention.

20. The method of claim 15, wherein the flow control device is one of multiple flow control devices in the well system, and wherein the adjusting step further comprises regulating a phase change profile of the first fluid in a subterranean formation by adjusting flow of the first fluid through each of the multiple flow control devices.

* * * * *